US009583043B2

(12) United States Patent
Mizukoshi

(10) Patent No.: US 9,583,043 B2
(45) Date of Patent: Feb. 28, 2017

(54) ORGANIC LIGHT EMITTING DISPLAY CAPABLE OF COMPENSATING FOR LUMINANCE VARIATIONS CAUSED BY CHANGES IN DRIVING ELEMENT OVER TIME AND METHOD OF MANUFACTURING THE SAME

(71) Applicant: LG Display Co., Ltd., Seoul (KR)

(72) Inventor: Seiichi Mizukoshi, Kanagawa (JP)

(73) Assignee: LG Display Co., Ltd., Seoul (KR)

( * ) Notice: Subject to any disclaimer, the term of this patent is extended or adjusted under 35 U.S.C. 154(b) by 104 days.

(21) Appl. No.: 14/576,605

(22) Filed: Dec. 19, 2014

(65) Prior Publication Data

US 2016/0078813 A1 Mar. 17, 2016

(30) Foreign Application Priority Data

Sep. 11, 2014 (KR) ..... 10-2014-0120043

(51) Int. Cl.
*G09G 3/32* (2016.01)
*G09G 5/10* (2006.01)

(52) U.S. Cl.
CPC ..... *G09G 3/3291* (2013.01); *G09G 3/3233* (2013.01); *G09G 3/3283* (2013.01); *G09G 2300/0842* (2013.01); *G09G 2310/027* (2013.01); *G09G 2320/0285* (2013.01); *G09G 2320/0295* (2013.01); *G09G 2320/043* (2013.01); *G09G 2360/16* (2013.01)

(58) Field of Classification Search
CPC ..... G09G 5/10; G09G 3/3283; G09G 3/3241; G06F 3/14
USPC ..... 345/530, 691
See application file for complete search history.

(56) References Cited

U.S. PATENT DOCUMENTS 7,834,825 B2 11/2010 Mizukoshi et al.
2008/0001957 A1* 1/2008 Hancock ..... G06F 3/14 345/530
2013/0093652 A1 4/2013 Kim et al.
2014/0022289 A1* 1/2014 Lee ..... G09G 3/3283 345/691

(Continued)

FOREIGN PATENT DOCUMENTS

KR 10-2013-0039551 A 4/2013

*Primary Examiner* — Nicholas Lee
*Assistant Examiner* — Abdul-Samad A Adediran
(74) *Attorney, Agent, or Firm* — Morgan, Lewis & Bockius LLP

(57) ABSTRACT

Provided are an organic light emitting display and a method of manufacturing the same. The organic light emitting display includes: a display panel including a plurality of pixels, each pixel including: a light emitting element, and a driving element to drive the light emitting element, a data driving circuit to, within one horizontal display period: write sensing data to a pixel on a horizontal display line through a data line, sense the pixel current of the pixel through a reference line, and then write display data compensated by a first offset compensation value to the pixel, an offset calculator to calculate a second offset compensation value for compensating changes in the driving element over time based on the sensed value of the pixel current, and an offset memory to update the pre-stored first offset compensation value with the second offset compensation value when display data writing is stopped.

18 Claims, 24 Drawing Sheets

(56) References Cited

U.S. PATENT DOCUMENTS

2016/0055791 A1* 2/2016 Kishi ..... G09G 3/3241
345/212

* cited by examiner

ORGANIC LIGHT EMITTING DISPLAY CAPABLE OF COMPENSATING FOR LUMINANCE VARIATIONS CAUSED BY CHANGES IN DRIVING ELEMENT OVER TIME AND METHOD OF MANUFACTURING THE SAME

CROSS-REFERENCE TO RELATED APPLICATION(S)

The present application claims benefit and priority under 35 U.S.C. §119(a) of Korean Patent Application No. 10-2014-0120043, filed on Sep. 11, 2014, the entire disclosure of which is hereby incorporated by reference herein for all purposes.

BACKGROUND

1. Technical Field

The present disclosure relates to an active matrix type organic light emitting display, and more particularly, to an organic light emitting display capable of compensating for luminance variations caused by changes in a driving element over time and a method of manufacturing the same.

2. Discussion of the Related Art

An organic light emitting display is a self-emissive device in which an organic light emitting layer emits light by recombination of electrons and holes, and is expected to be a next-generation display device in that it is high in luminance, low in driving voltage, and ultra-thin in thickness.

Each of a number of pixels included the organic emitting display includes an organic light emitting diode (OLED), which is a light emitting element including an anode, a cathode, and an organic emitting layer formed between them, and a pixel circuit for driving the OLED independently. The pixel circuit usually includes a switching thin film transistor (TFT), a storage capacitor, and a driving element (driving TFT). The switching TFT charges the capacitor with a data voltage in response to a scan signal, and adjusts the emission intensity of the OLED by controlling the magnitude of electrical current supplied to the OLED according to the level of the voltage stored in the capacitor. The emission intensity of the OLED proportional to the current supplied from the driving TFT.

The organic light emitting display have differences in characteristics such as the threshold voltage Vth, mobility, etc. of the driving TFT of each pixel due to process deviations or the like. Hence, the amount of driving current for driving the OLED varies, causing luminance variations between the pixels. In general, initial differences in the characteristics of the driving TFT cause spots or inconsistencies of the display (mura) on the screen, and differences in the characteristics of the driving TFT made over time during the driving of the OLED can reduce the lifespan of the display panel or produce afterimages.

U.S. Pat. No. 7,834,825 discloses a data compensation method which measures electrical current in each pixel and compensates input data according to the measurement result. However, this related art patent is based upon the premise that the characteristics of the driving TFT are not changed after shipment, without taking into account luminance variations caused by changes in a driving TFT over time.

FIG. 1 is a schematic diagram showing a related art organic light emitting display. FIG. 2 is a timing diagram showing the timings of when image display gate signals and sensing gate signals are supplied in the organic light emitting display of FIG. 1.

Korean Laid-Open Patent Publication No. 10-2013-0039551 (also published as U.S. Patent Application Publication No. 2013/0093652) discloses a method for compensating for luminance variations caused by changes in a driving element over time. In this related art technology, as shown in FIG. 2 of the present disclosure, one frame ("1 Frame") is divided into a display period DP and a vertical blank period VB, and the OLED of each pixel emits light during the display period to display an image and the threshold voltage of a driving TFT (DT) is measured during the vertical blank period VB. In the related art technology, however, a first gate driver 2A for generating image display gate signals D11 to Dn2 and a second gate driver 2B for generating sensing gate signals S11 to Sn2 need to be included as shown in FIG. 1 of the present disclosure. Also, a multiplexer circuit 3 for selectively supplying the gate signals D11 to Dn2 and S11 to Sn2 (collectively labeled "sensing") input from the gate driver 2 to the display panel needs to be further included. Thus, it is difficult to reduce the bezel area of the display panel. In FIG. 1, "1" denotes a data driver, "RL" denotes a reference line required for sensing, "DL" denotes a data line to which a data voltage is applied, "GLa" denotes a first gate line connected to a first switch TFT ST1 included in a pixel P, "GLb" denotes a second gate line connected to a second switch TFT ST2 included in the pixel P, "DT" denotes a driving TFT included in the pixel P, and "Cst" denotes a storage capacitor included in the pixel P. Each of the pixels P receives high-potential power EVDD and low-potential power EVSS from a power generator (not shown).

Moreover, this related art technology has the problem of display image distortion that occurs when display data applied to pixels to be sensed does not have the same value for one frame but is converted into sensing data during the vertical blank period VB.

SUMMARY

Accordingly, embodiments of the present application are directed to an organic light emitting display and a method of manufacturing the same that substantially obviate one or more problems due to limitations and disadvantages of the related art.

An object of embodiments is to provide an organic light emitting which is capable of sensing a pixel current in pixels to be sensed within a display period of one frame allocated for display data writing and compensating for luminance variations caused by changes in a driving element over time based on the sensed pixel current.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose according to one aspect of the invention, an organic light emitting display includes: a display panel including a plurality of pixels, each pixel including: a light emitting element, and a driving element configured to drive the light emitting element, a data driving circuit configured to, within one horizontal display period allocated to each horizontal display line of the display panel to write image display data: write sensing data to a pixel on a horizontal display line through a data line, sense the pixel current of the pixel through a reference line, and then write display data compensated by a first offset compensation value to the pixel, an offset calculator configured to calculate a second offset compensation value for compensating changes in the driving element over time based on the sensed value of the pixel current, and an offset memory configured to update the pre-stored first offset compensation value with the second offset compensation value within a vertical blank period when display data writing is stopped.

In another aspect, a method of manufacturing an organic light emitting display includes: providing a display panel including a plurality of pixels, each pixel including: a light emitting element, and a driving element configured to drive the light emitting element, providing a data driving circuit configured to, within one horizontal display period allocated to each horizontal display line of the display panel to write image display data: write sensing data to a pixel on a horizontal display line through a data line, sense the pixel current of the pixel through a reference line, and then write display data compensated by a first offset compensation value to the pixel, providing an offset calculator configured to calculate a second offset compensation value for compensating changes in the driving element over time based on the sensed value of the pixel current, and providing an offset memory configured to update the pre-stored first offset compensation value with the second offset compensation value within a vertical blank period when display data writing is stopped.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, which are included to provide a further understanding of the invention and are incorporated in and constitute a part of this specification, illustrate implementations of the invention and together with the description serve to explain the principles of the invention.

Figure 1:
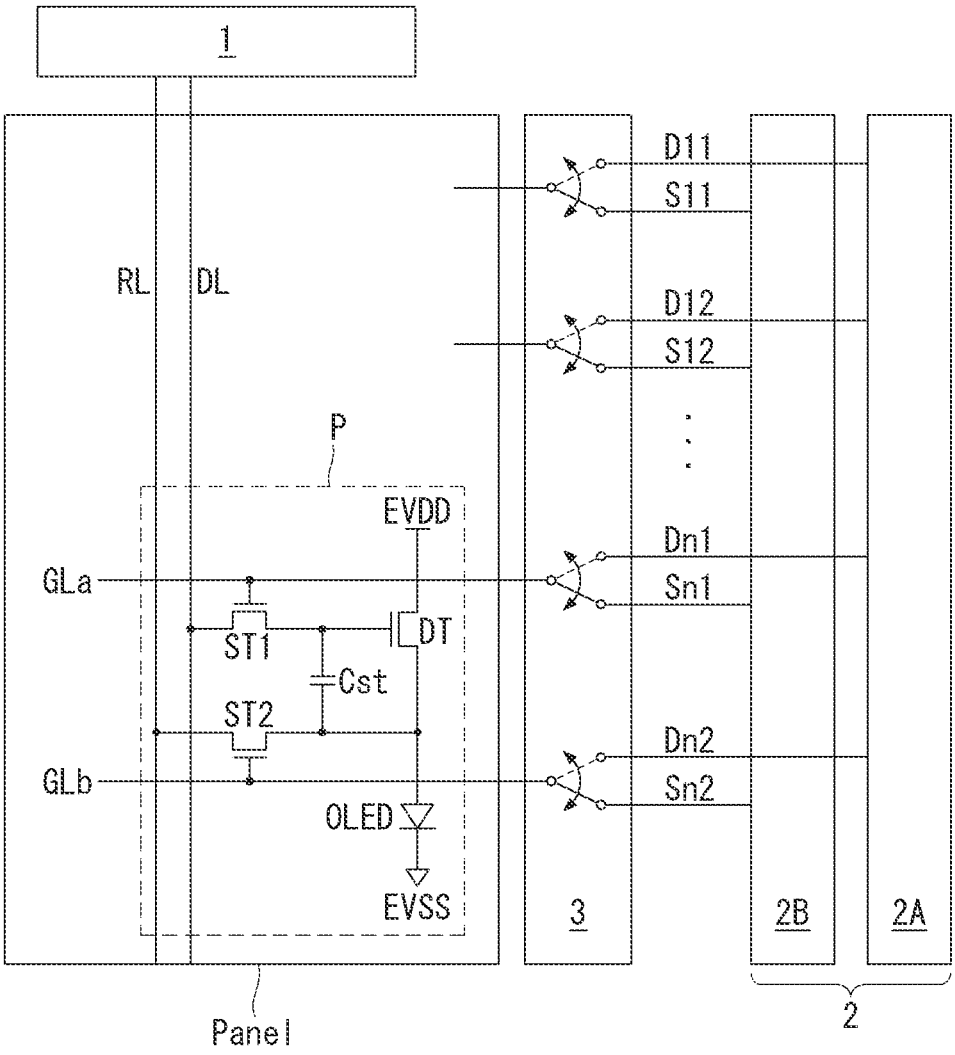
FIG. 1 (Related Art)
FIG. 1 is a schematic diagram showing a related art organic light emitting display.
Figure 2:
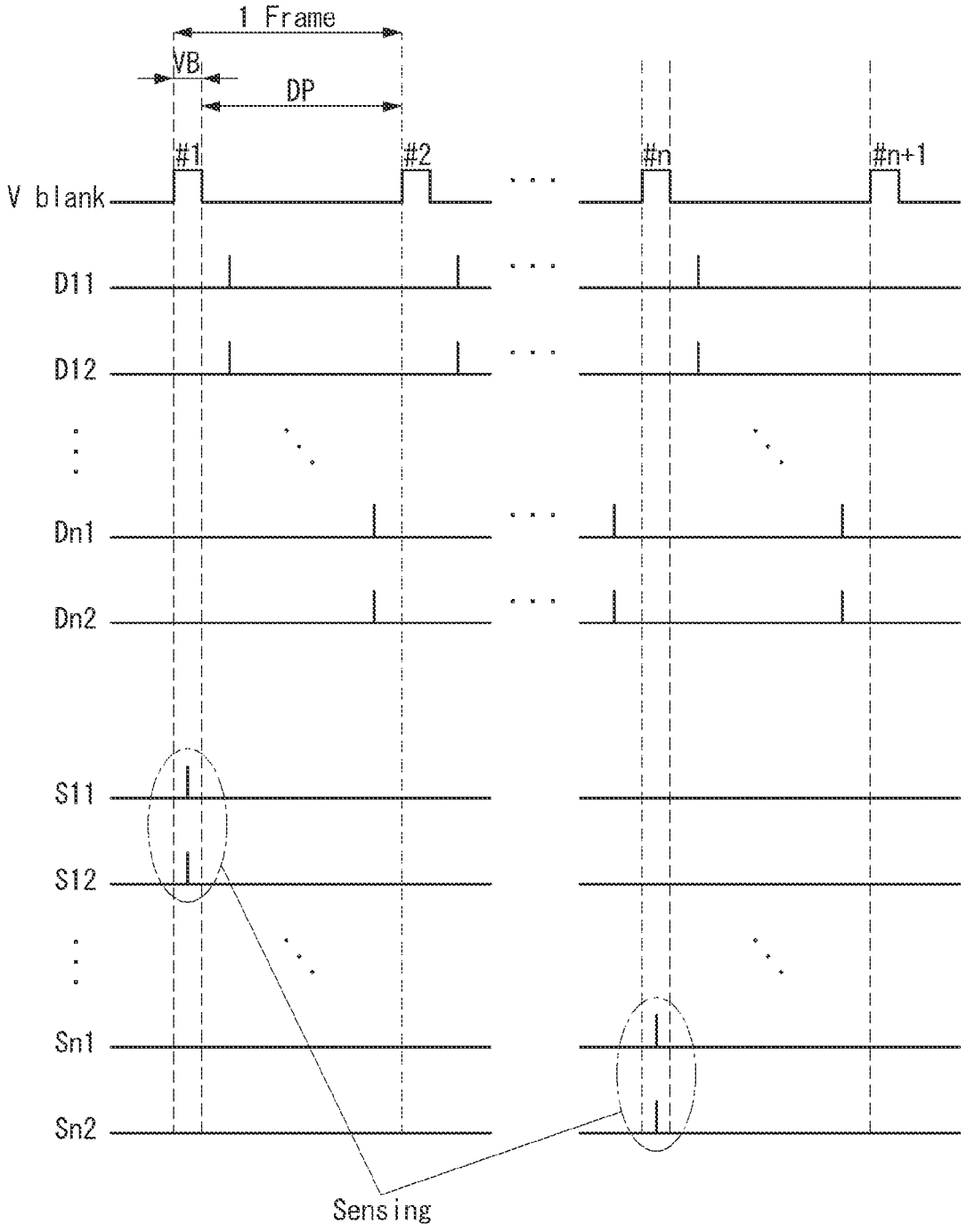
FIG. 2 (Related Art)
FIG. 2 is a timing diagram showing when image display gate signals and sensing gate signals are supplied in the organic light emitting display of FIG. 1.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present invention, examples of which are illustrated in the accompanying drawings. In the following description, when a detailed description of well-known functions or configurations related to this document is determined to unnecessarily cloud a gist of the invention, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a certain order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

Hereinafter, embodiments will be described in detail with reference to the accompanying drawings.

Figure 3:
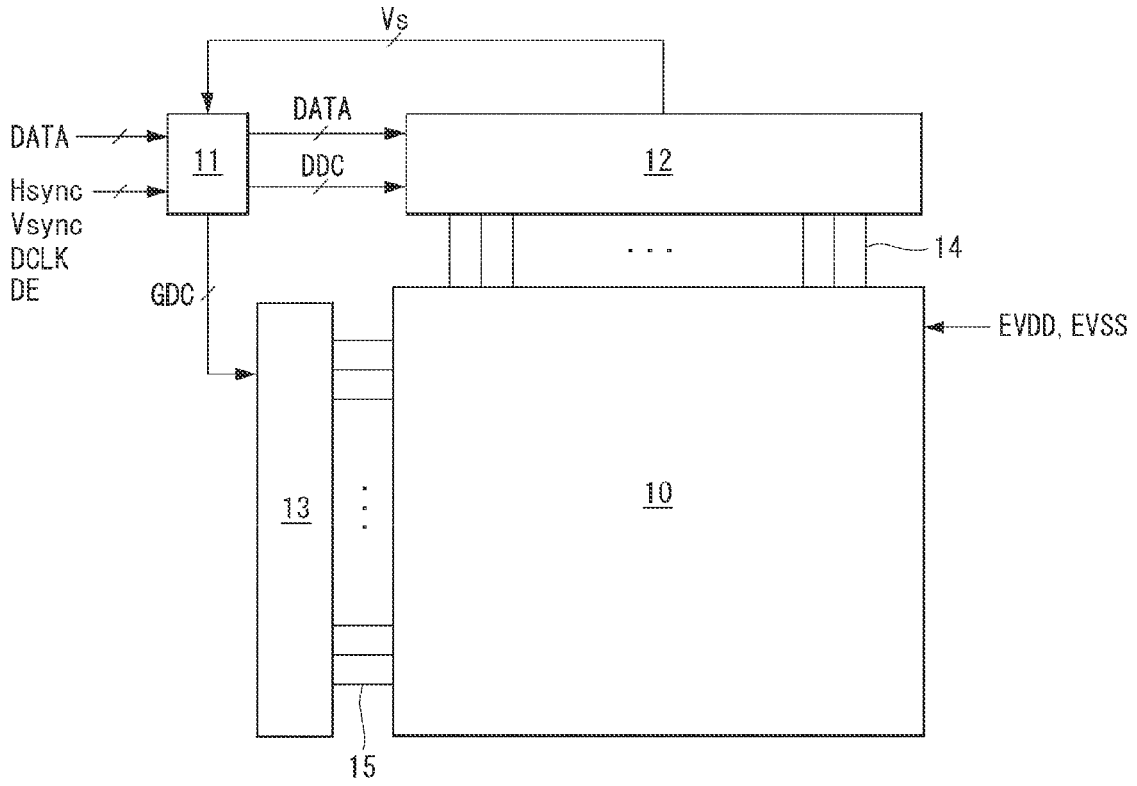
FIG. 3 is a block diagram showing an organic light emitting display according to an embodiment.
Figure 4:
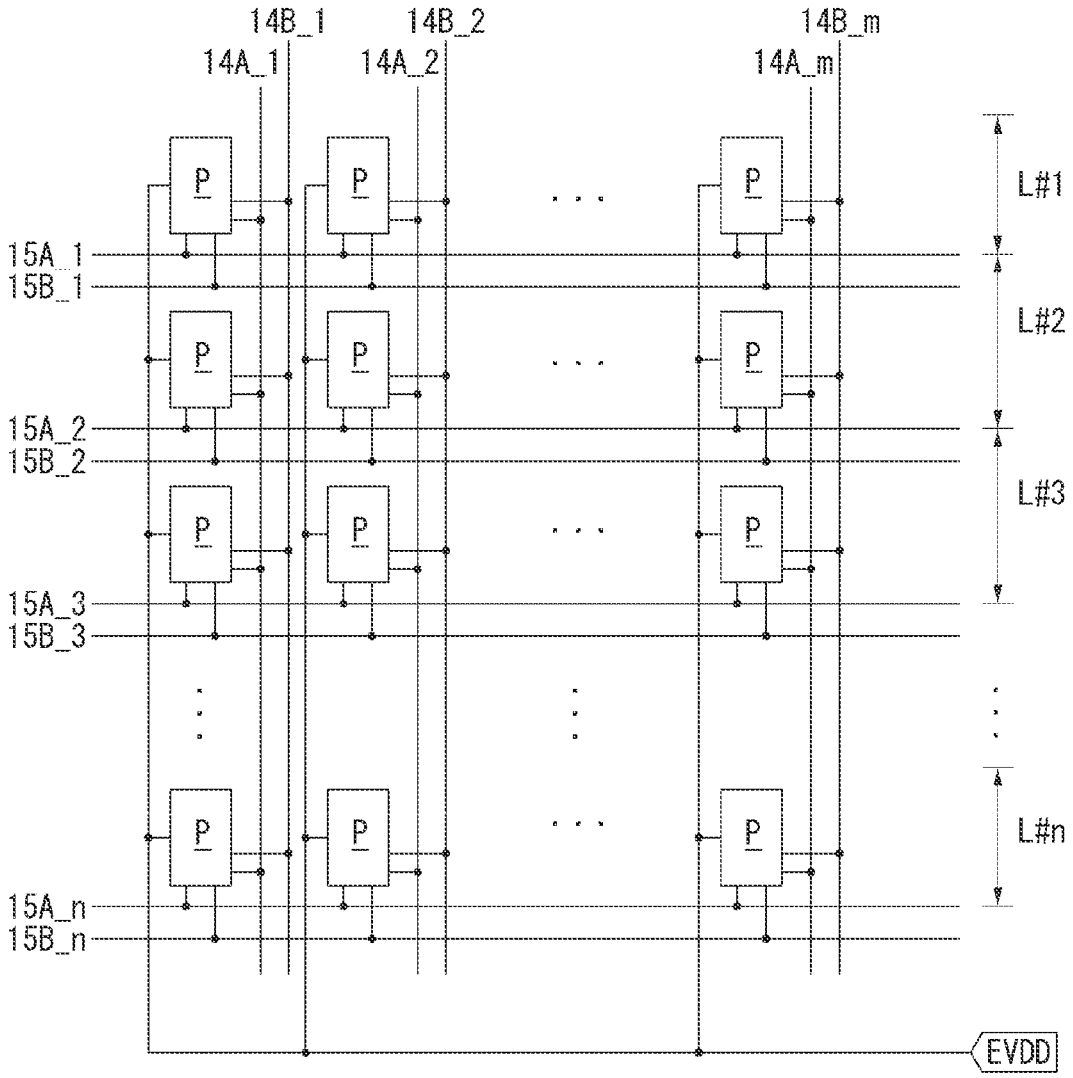
FIG. 4 is a schematic diagram showing a pixel array formed on the display panel of FIG. 3.
Figure 5:
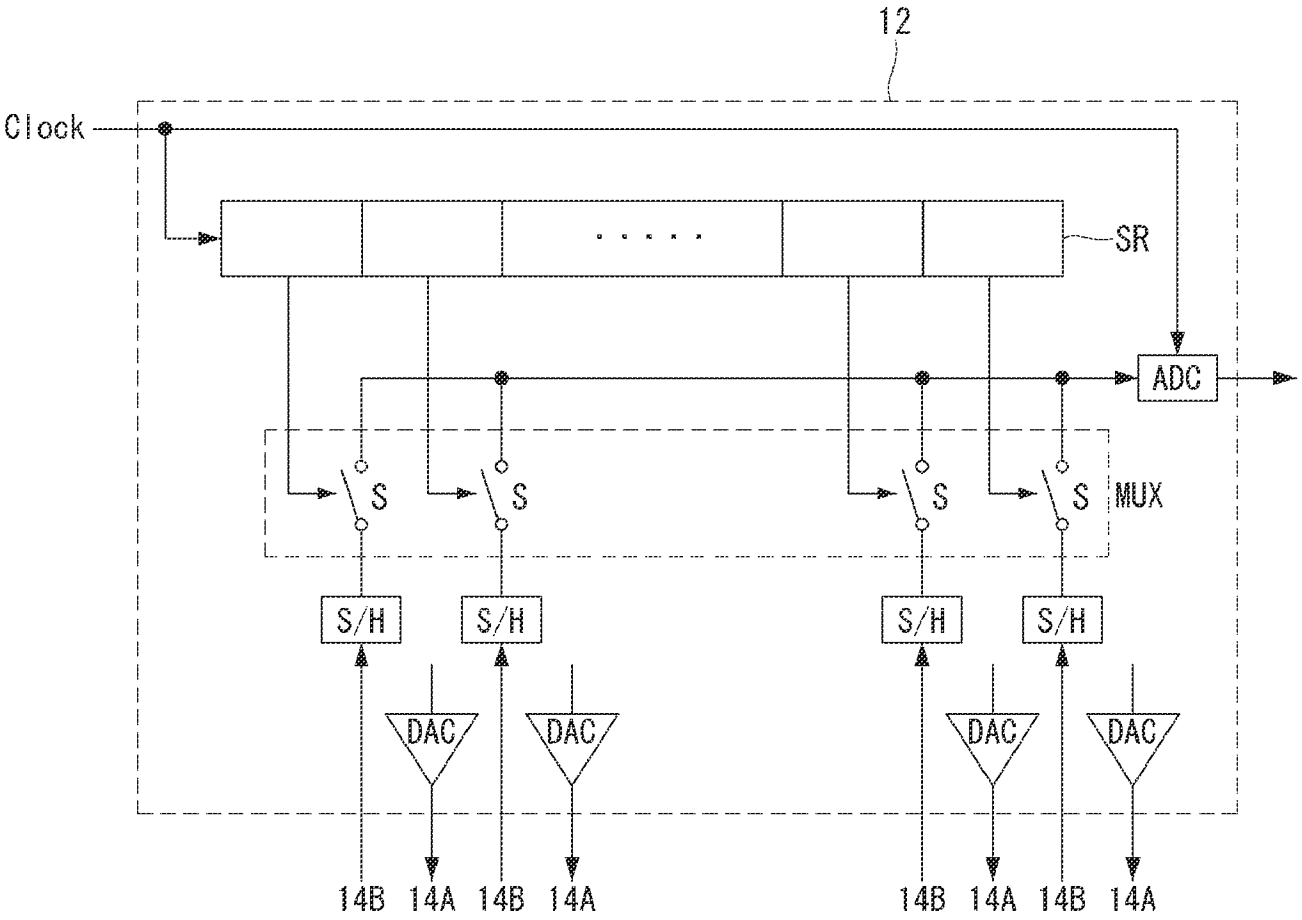
FIG. 5 is a schematic diagram showing an internal configuration of the gate driving circuit of FIG. 3.
Figure 6:
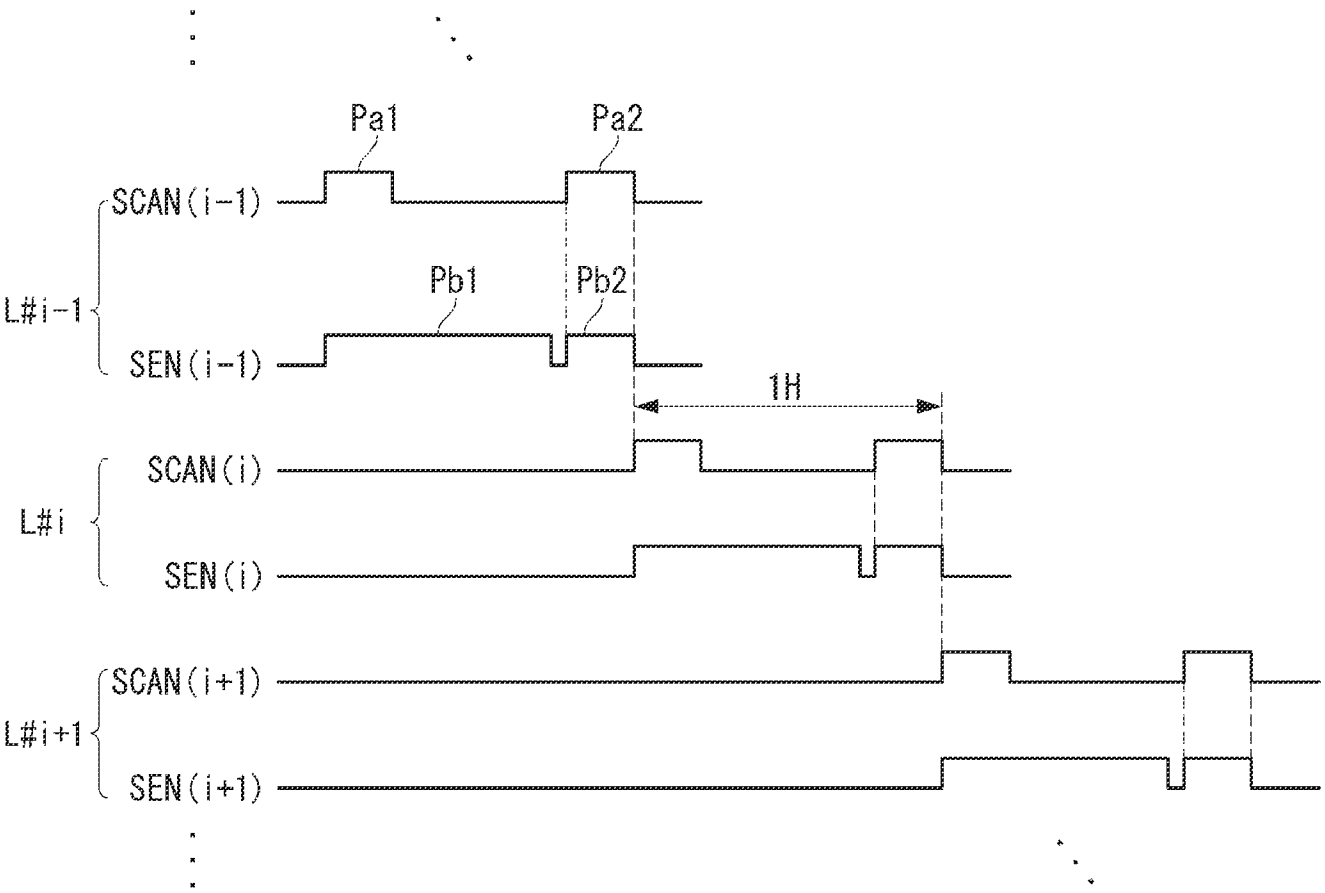
FIG. 6 is a timing diagram showing the timings of supply of scan control signals and sensing control signals generated by the gate driving circuit of FIG. 3.
Figure 7:
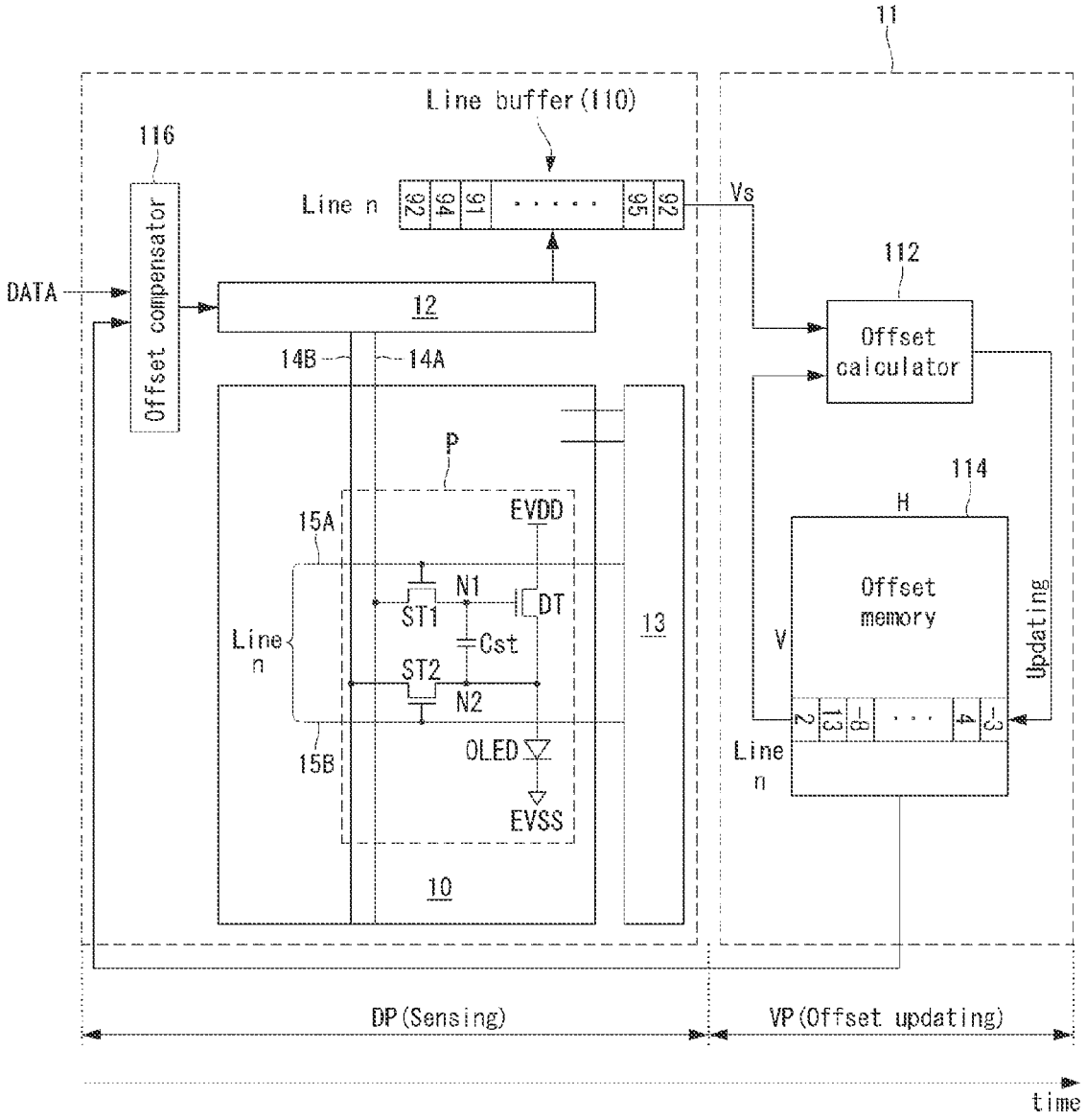
FIG. 7 is a schematic diagram showing a configuration of an embodiment for performing a sensing operation within a display period and an offset update operation within a vertical blank period.

FIG. 3 is a block diagram showing an organic light emitting display according to an embodiment. FIG. 4 is a schematic diagram showing a pixel array formed on the display panel of FIG. 3. FIG. 5 is a schematic diagram showing an internal configuration of the gate driving circuit of FIG. 3. FIG. 6 is a timing diagram showing the timings of supply of scan control signals and sensing control signals generated by the gate driving circuit of FIG. 3. FIG. 7 is a schematic diagram showing a configuration of an embodiment for performing a sensing operation within a display period and an offset update operation within a vertical blank period.

With reference to the examples of FIGS. 3 and 4, the organic light emitting display according to an embodiment may include a display panel 10, a timing controller 11, a data driving circuit 12, and a gate driving circuit 13. A plurality of source lines 14 and a plurality of gate lines 15 may cross each other on the display panel 10, and pixels P may be arranged in a matrix form at crossings of the source lines 14 and the gate lines 15. The source lines 14 may include m ("m" being a positive integer) data lines 14A_1 to 14A_m and m reference lines 14B_1 to 14B_m. The gate lines 15 may include n ("n" being a positive integer) first gate lines 15A_1 to 15A_n and n second gate lines 15B_1 to 15B_n.

Each of the pixels P may receive a high-potential power EVDD and a low-potential power EVSS from a power source (not shown). TFTs included in a pixel P may be either p-type or n-type. A semiconductor layer of the TFTs in the pixel P may include, e.g., amorphous silicon, polysilicon, or an oxide. Each pixel P may be connected to any one of the data lines 14A1_ to 14A_m, any one of the reference lines 14B_1 to 14B_m, any one of the first gate lines 15_A1 to 15A_n, and any one of the second gate lines 15B_1 to 15B_n.

The timing controller 11 may generate a data control signal DDC for controlling the operation timing of the data driving circuit 12 and a gate control signal GDC for controlling the operation timing of the gate driving circuit 13, based on timing signals such as a vertical synchronization signal Vsync, a horizontal synchronization signal Hsync, a dot clock signal DCLK, and a data enable signal DE. The data driving circuit 12 may drive the data lines 14A1_ to 14A_m and the reference lines 14B_1 to 14B_m in response to the data control signal DDC from the timing controller 11. As shown in the FIG. 5 example, the data driving circuit 12 may include digital-to-analog converters DAC connected to each data line 14A, sampling and holding circuits S/H connected to each reference line 14B, and a multiplexer MUX (including a plurality of switches S) for sequentially supplying the output of the sampling and holding circuits S/H to one analog-to-digital converter ADC under the control of a shift register SR.

The gate driving circuit 13 may generate a gate pulse in response to the gate control signal GDC from the timing controller 11. The gate pulse may include a scan control signal SCAN (FIG. 6) sequentially supplied to the first gate lines 15A_1 to 15A_n and a sensing control signal SEN (FIG. 6) sequentially supplied to the second gate lines 15B_1 to 15B_n.

To overcome the problems of the related art, the organic light emitting display according to an embodiment may derive an offset compensation value for compensating for luminance variations caused by changes in the threshold voltage of the driving TFTs by performing a sensing operation within a display period of one frame allocated for display data writing, and may update the offset compensation value within a vertical blank period between two display periods during which no display data is written. To this end, the data driving circuit 12 may write sensing data (Va in FIG. 9, VPRE in FIGS. 16 and 20) to a pixel on each horizontal display line through the data line 14, may sense the pixel current of the pixel through the reference line 14B, and then may write display data compensated by a first offset compensation value to the pixel, within one horizontal display period 1H allocated to each horizontal display line L#1 to L#n of the display panel 10 to write image display data.

As shown in the FIG. 6 example, the gate driving circuit 13 may generate a scan control signal SCAN in the form of two pulses Pa1 and Pa2 during one horizontal display period 1H and supplies it to the first gate lines 15A_1 to 15A_n in a line-sequential manner L#1 to L#n (e.g., L#1, . . . L#i−1, L#i, L#i+1, . . . L#n). Also, the gate driving circuit 13 may generate a sensing control signal SEN in the form of two pulses Pb1 and Pb2 during one horizontal display period 1H, and may supply the sensing control signal SEN to the second gate lines 15B_1 to 15B_n in a line-sequential manner L#1 to L#n. The first pulse Pa1 of the scan control signal SCAN and the first pulse Pb1 of the sensing control signal SEN, supplied to the same pixel, may rise simultaneously, but the first pulse Pa1 may fall earlier than the first pulse Pb1. Therefore, the first pulse Pb1 may have a wider pulse width than the first pulse Pa1. The second pulse Pa2 of the scan control signal SCAN and the second pulse Pb2 of the sensing control signal SEN, supplied to the same pixel, may rise and fall simultaneously and therefore may have the same pulse width.

In this way, the gate driving circuit 13 may control both the sensing data writing operation and the display data writing operation at a time within one horizontal display period 1H by using a single scan control signal and a single sensing control signal, both having two pulses during one horizontal display period 1H. Accordingly, there may be no need to include a sensing gate driver and a display gate driver, and no additional multiplexer for selecting the output of gate drivers may be required. This may offer advantages in reducing the bezel area.

As shown in FIG. 7, an example of a pixel P to which embodiments are applicable may include an OLED, a driving TFT DT, a storage capacitor Cst, a first switching TFT ST1, and a second switching TFT ST2. The OLED may include an anode connected to a source node N2, a cathode connected to a low-potential power source EVSS, and an organic compound layer located between the anode and the cathode.

The driving TFT DT may include a gate electrode connected to a gate node N1, a drain electrode connected to a high-potential power source EVDD, and a source electrode connected to the source node N2. The driving TFT DT may control the amount of electric current applied to the OLED according to a gate-source potential difference Vgs. The driving TFT may turn on when the gate-source potential difference is larger than a threshold voltage Vth. The larger the gate-source potential difference, the greater the pixel current that flows between the source and drain of the driving TFT DT. If the potential of the source node N2 becomes higher than the turn-on voltage of the OLED due to the pixel current, the pixel current may flow through the OLED to make the OLED emit light. The emission intensity of the OLED is proportional to the magnitude of the pixel current, and grayscale representation depends on emission intensity.

The first switching TFT ST1 may include a gate electrode connected to a first gate line 15A, a drain electrode connected to a date line 14A, and a source electrode connected to the gate node. The first switching TFT ST1 may be switched on in response to a scan control signal SCAN to apply the data voltage (corresponding to sensing data or display data) stored in the data line 14A to the gate node N1.

The gate electrode of the second switching TFT ST2 may be connected to a second gate line 15B, the drain electrode of the second switching TFT ST2 may be connected to the source node N2, and the source electrode of the second switching TFT ST2 may be connected to a reference line 14B. The second switching TFT ST2 may be switched on in response to a sensing control signal SEN to apply a reference voltage from the reference line 14B to the source node N2 or may supply the current flowing through the driving TFT DT, e.g., the pixel current, to the reference line 14B. The storage capacitor Cst may be connected between the gate node N1 and the source node N2 to maintain the gate-source voltage Vgs of the driving TFT DT.

As shown in the example of FIG. 7, the timing controller 11 may further include a line buffer 110, an offset calculator 112, an offset memory 114, and an offset compensator 116, in order to derive and update a offset compensation value. The offset compensator 116 and the line buffer 110 may be embedded in the data driving circuit 12.

The line buffer 110 may temporarily store sensed values of pixel current corresponding to one horizontal display line. The offset calculator 112 may calculate a second offset compensation value for each pixel P for compensating for luminance variations caused by changes in the driving TFT DT over time (e.g., changes in the threshold voltage of the driving TFT during one sensing period), based on the sensed values input from the line buffer 110. The offset memory 114 may update the first offset compensation value stored through the previous sensing operation with the second offset compensation value within a vertical blank period when display data writing is stopped.

The offset compensator 116 may apply the first offset compensation value to input display data and input sensing data, respectively, and then may supply the display data and the sensing data to the data driving circuit 12.

Figure 8:
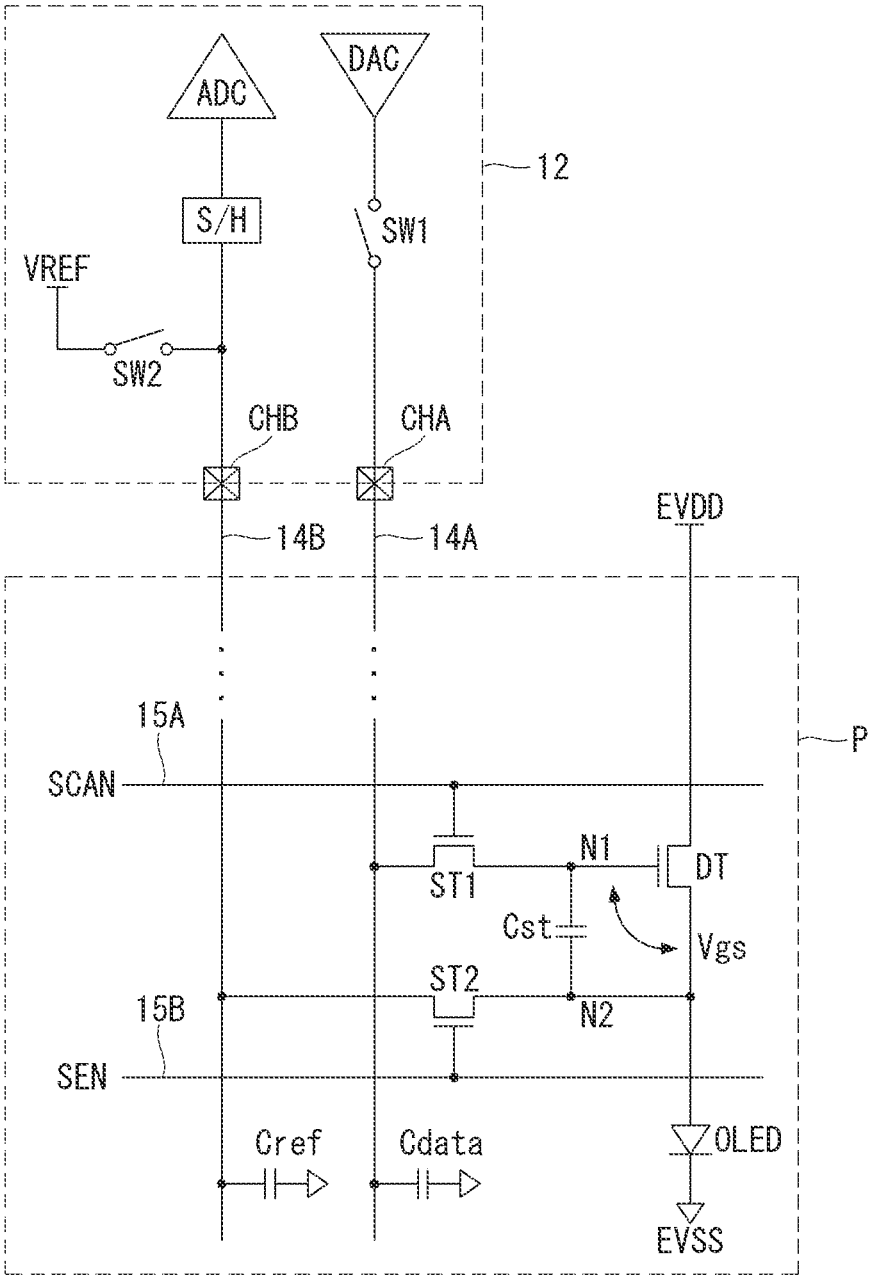
FIG. 8 is a circuit diagram showing a pixel configuration and a data driving circuit configuration for sensing pixel current.
Figure 9:
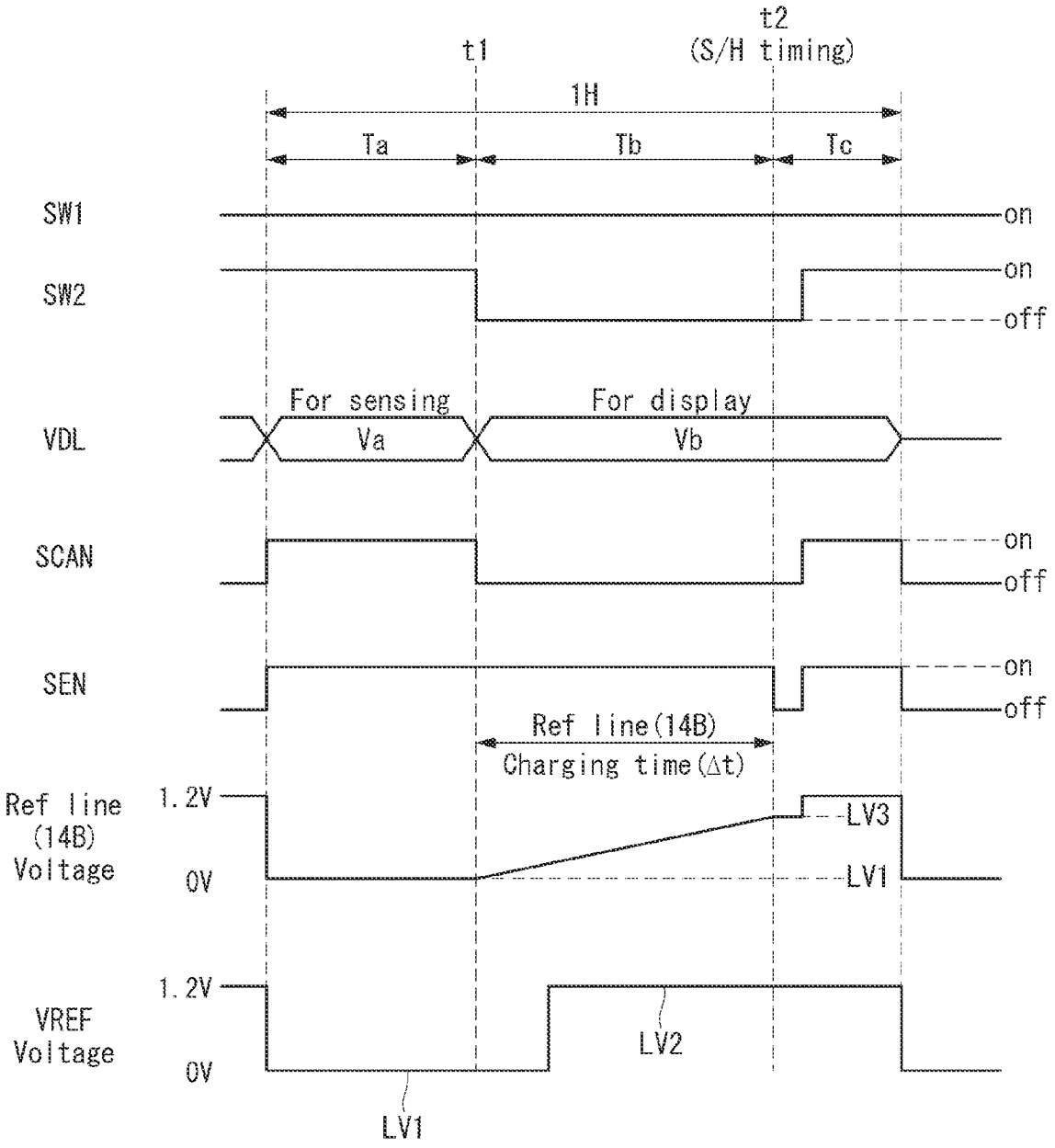
FIG. 9 is a timing diagram showing a driving timing for explaining the operation of FIG. 8.

FIG. 8 is a circuit diagram showing a pixel configuration and a data driving circuit configuration for sensing pixel current. FIG. 9 is a timing diagram showing a driving timing for explaining the operation of FIG. 8.

With reference to the FIG. 8 example, the data driving circuit 12 may further include a first channel CHA connected to a data line 14A to sense the pixel current flowing through a first pixel P, a first switch SW1 connected between a DAC and the first channel CHA, a second channel CHB connected to a reference line 14B, and a second switch SW2 connected between a reference voltage source VREF and the second channel CHB.

When one horizontal display period is allocated to drive the pixels located on the same horizontal display line, the one horizontal display period may be time-divided into a first period Ta for writing sensing data Va to the first pixel P, a second period Tb for sensing the voltage stored in the reference line 14B in response to the pixel current from the first pixel P, and a third period Tc for writing display data Vb to the first pixel P, as shown in the FIG. 9 example, in order to perform a sensing operation within a display period.

The first switch SW1 may be turned on in the first period Ta to apply the sensing data Va from the DAC to the data line 14A, and turned on in the second period Tb and the third period Tc to apply the display data Vb from the DAC to the data line 14A. As the display data Vb is applied to the pixel P in the third period Tc, the second period Tb is significant in that the data line 14A may be pre-charged with the display data Vb.

The second switch SW2 may be turned on in the first period Ta to apply a first reference voltage LV1 from the reference voltage source VREF to the reference line 14B, and turned on in the third period Tc to apply a second reference voltage LV2, different form the first reference voltage LV1, to the reference line 14B. The first reference voltage LV1 should be within a range where the maximum value of the voltage stored in the reference line 14B in response to the pixel current is lower than the turn-on voltage of the OLED, in order to prevent unnecessary current from flowing through the OLED during the sensing operation. In an example embodiment, the first reference voltage LV1 may be set to 0 V. The second reference voltage LV2 should be set to a proper value that covers a full range of gray levels from black to white, e.g., 1.2 V in one example.

The scan control signal SCAN may be maintained at the on level in the first period Ta, maintained at the off level in the second period Tb, and then inverted from the off level to the on level within the third period Tc. Accordingly, in response to the scan control signal SCAN, the first switch TFT ST1 may be turned on in the first period Ta to apply the sensing data Va from the data line 14A to the gate node N1 of the pixel P, and turned on in the third period to apply the display data Vb from the data line 14A to the gate node N1 of the pixel P.

The sensing control signal SEN may be maintained at the on level in the first and second periods Ta, Tb and then inverted from the off level to the on level within the third period Tc. In other words, the sensing control signal SEN may be turned off at the end of the second period Tb, then turned on sometime during the third period Tc. Accordingly, in response to the sensing control signal SEN, the second switching TFT ST2 may be turned on in the first period Ta to apply the first reference voltage LV1 from the reference line 14B to the source node N2 of the pixel P, turned on in the second period Tb to reflect a change in the potential of the source node N2 of the pixel P to the reference line 14B, and turned on in the third period Tc to apply the second reference voltage LV2 from the reference voltage 14B to the source node N2 of the pixel P.

The potential of the reference line 14B to be sensed may be maintained at the first reference voltage LV1 in the first period Ta, and may gradually increase to a third reference voltage LV3 by the source-drain current of the driving TFT DT corresponding to the gate-source voltage Vgs of the driving TFT DT when the gate-source voltage Vgs of the driving TFT DT (i.e., the difference (Vgs=VA−LV1) between the sensing data Va and the first reference voltage LV1) is input into the storage capacitor at time t1. This potential change may be stored in a line capacitor Cref of the reference line 14B. The voltage stored in the reference line 14B may be sampled at time t2 immediately before the sensing control signal SEN is inverted to the off level.

Figure 10:
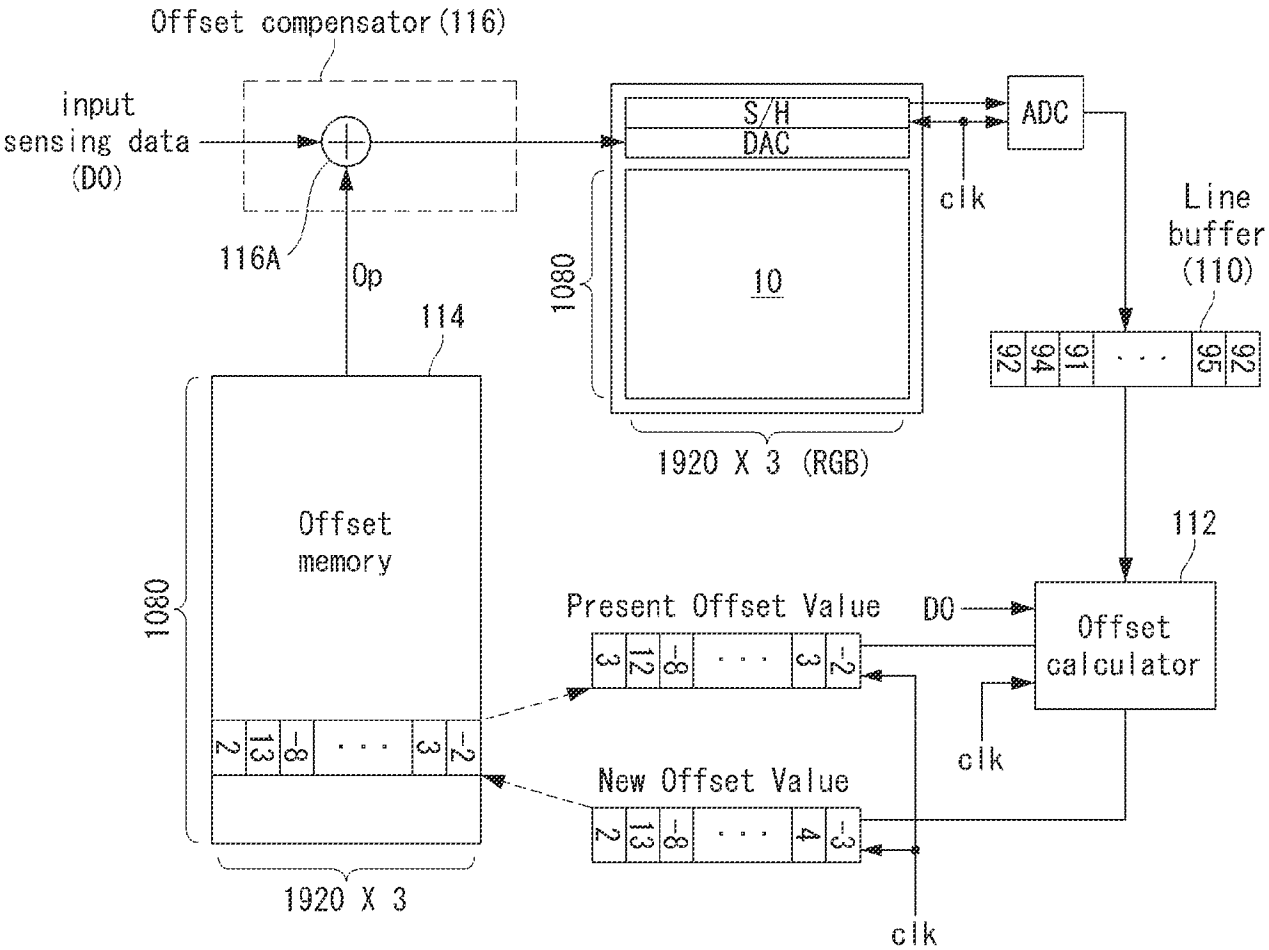
FIG. 10 is a schematic diagram showing a configuration for explaining in detail the derivation and update of an offset compensation value.
Figure 11:
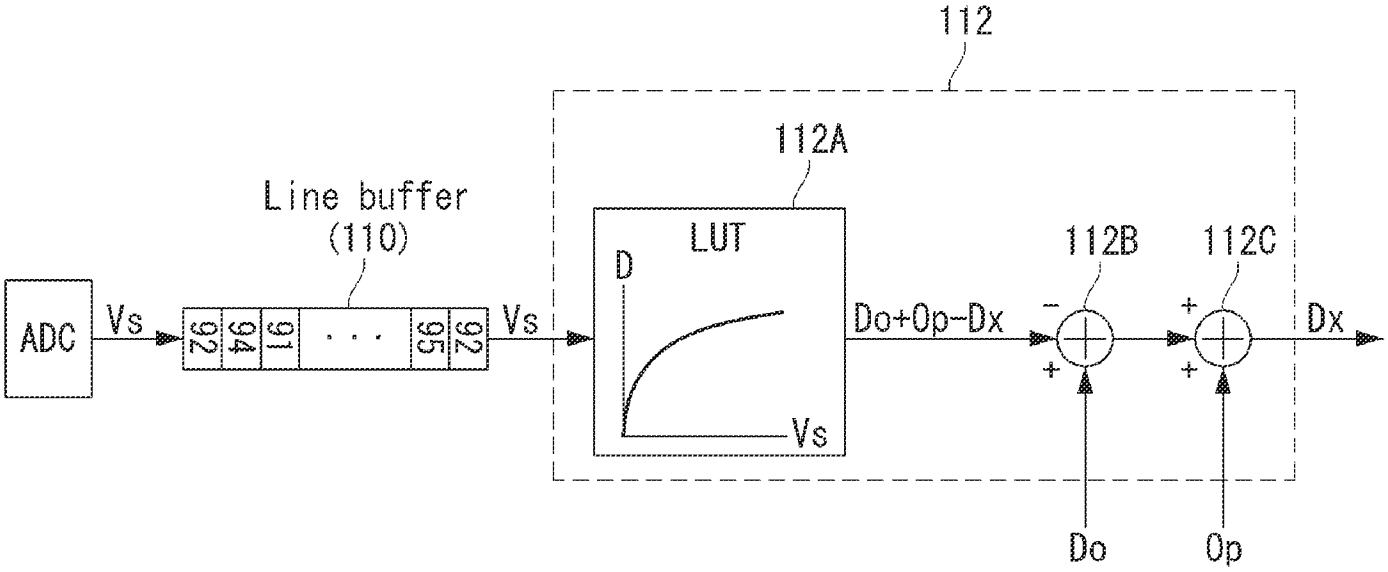
FIG. 11 is a schematic diagram showing a detailed configuration of the offset calculator of FIG. 10.
Figure 12:
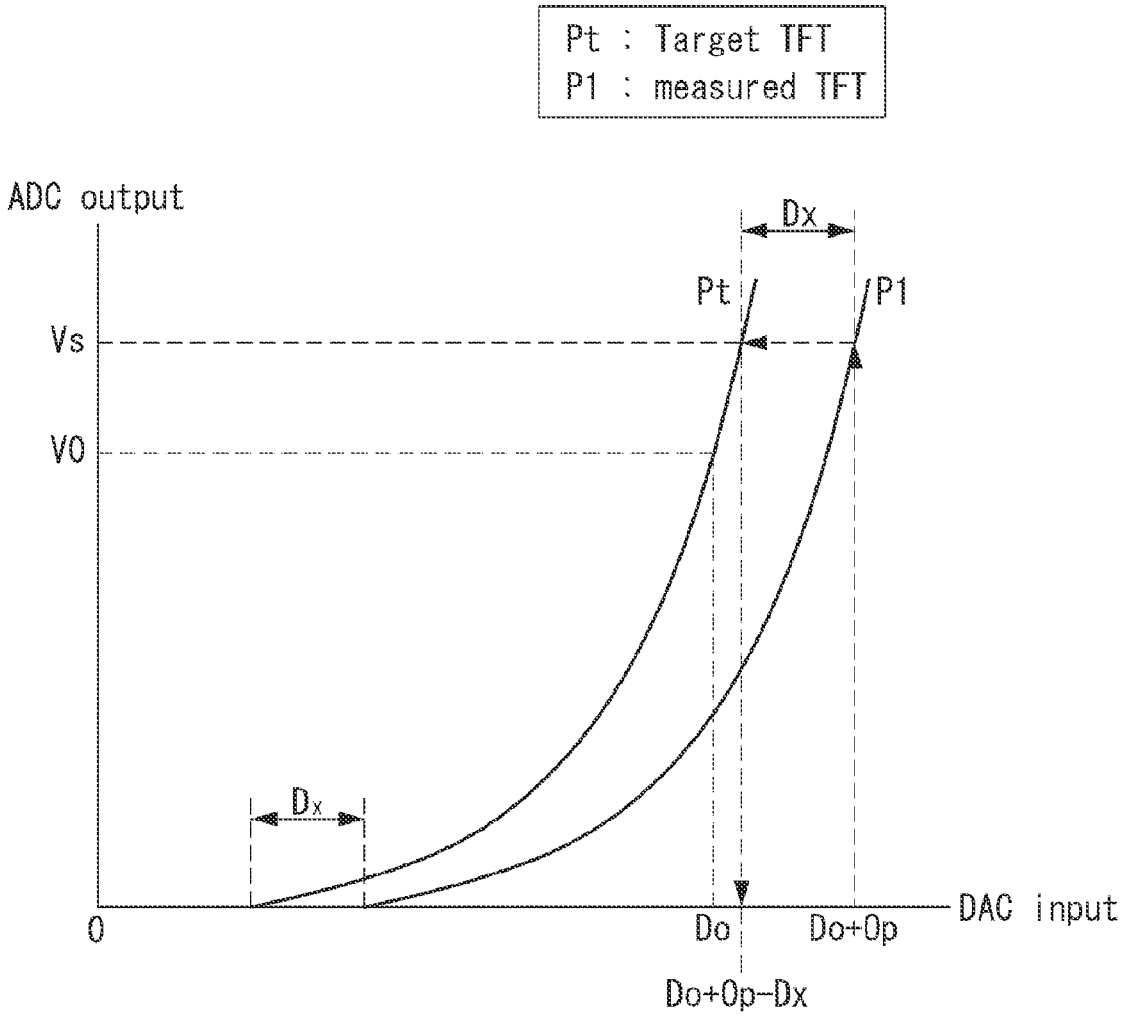
FIG. 12 is a graph for explaining a calculation principle associated with FIG. 11.
Figure 13:
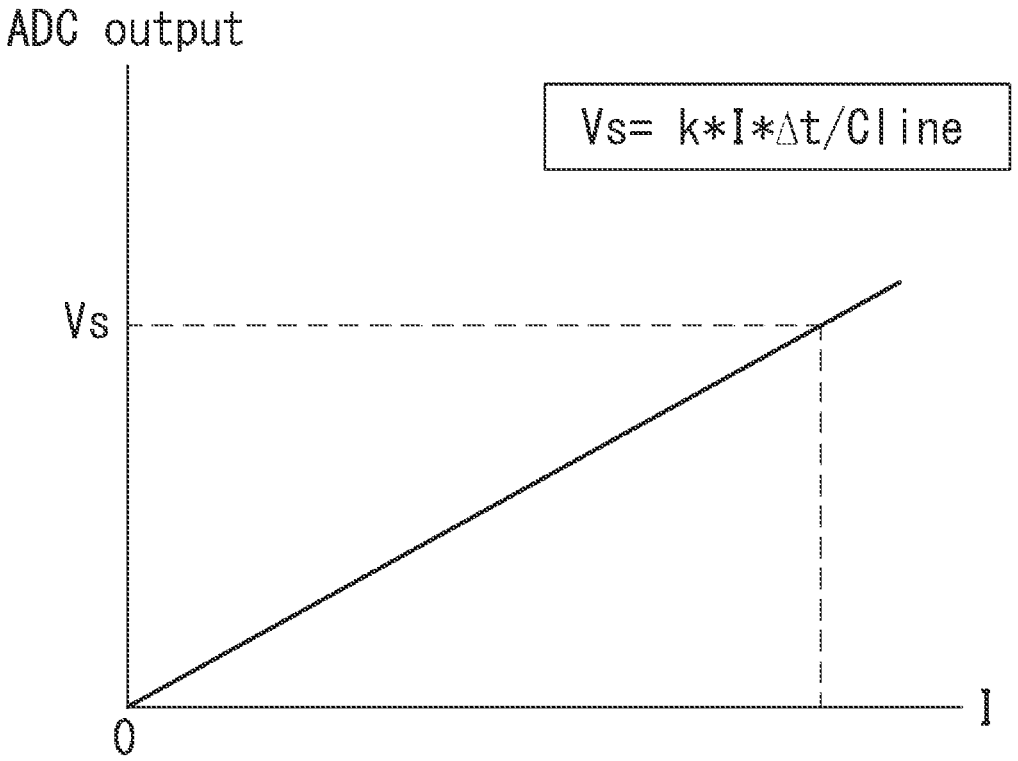
FIG. 13 is a graph showing the relationship between pixel current and ADC output.

FIG. 10 is a schematic diagram showing a configuration for explaining in detail the derivation and update of an offset compensation value. FIG. 11 is a schematic diagram showing detailed configuration of the offset calculator of FIG. 10. FIG. 12 is a graph for explaining a calculation principle associated with FIG. 11. FIG. 13 is a graph showing the relationship between pixel current and ADC output.

With reference to FIGS. 10 to 12, an adder 116A of the offset compensator 116 may add a first offset compensation value Op for each pixel stored in the offset memory to sensing data Do and then may supply the resultant value (Do+Op) to a DAC of the data driving circuit 12. The first offset compensation value Op added to the sensing data Do for the current sensing operation may have been updated in a previous sensing operation and stored in the offset memory 114. The DAC may convert the resultant value (Do+Op) into analog sensing data (Va of FIG. 9), and then may apply it to a measured pixel P through a data line 14A. When all measured pixels P on the same horizontal display line are sensed in the method explained with reference to FIGS. 8 and 9, the ADC may sequentially convert the sensed values from the target pixels P into digital values, and then may supply them to the line buffer 110.

Then, the offset calculator 112 may receive the sensed values Vs from the line buffer 110, and may calculate a second offset compensation value Dx for compensating for offset changes made to the measured pixels P during one sensing period (i.e., the time from the previous sensing point to the current sensing point) based on the sensed values Vs. To this end, as shown in the example of FIG. 11, the offset calculator 112 may include a lookup table 112A and adders 112B and 112C.

The lookup table 112A may output a first reference value (Do+Op−Dx) by using a sensed value Vs as a read address. The first reference value (Do+Op−Dx) may be preset for a target TFT Pt which may have no offset change during one sensing period, which may change with the sensed value along the Pt curve of FIG. 12. The P1 curve of the FIG. 12 example shows the characteristics of a measured TFT P1 included in a measured pixel P. The characteristics of the driving TFT P1 included in each measured pixel P may be based on the premise that the driving TFT P1 has the same characteristic-curve slope as the target TFT Pt. That is, it may be presumed that the mobility of the driving TFT P1 included in each measured pixel P does not change over time. Therefore, the driving TFT P1 may exhibit the same output current characteristics corresponding to input data as the target TFT Pt so long as there is compensation for the offset difference. Moreover, ADC output may be in proportion to pixel current I, as illustrated in FIG. 13. In the equation of FIG. 13, "Vs" indicates the sensed value, "I" indicates the pixel current flowing through the measured driving TFT P1, "Cline" denotes the line capacitor of the reference line 14B, "At" indicates the charging time (Tb of FIG. 9) of the line capacitor Cline, and "k" indicates the ADC conversion coefficient.

The adders 112B and 112C may output a second offset compensation value Dx for compensating for offset changes made to the measured TFT P1 with respect to the target TFT Pt by subtracting the sensing data (Do+Op) and first reference value (Do+Op−Dx) corresponding to the same sensed value Vs. The ADC output, which is the sensed value Vs corresponding to the pixel current, may be the same both when the sensing data (Do+Op) is input into the measured TFT P1 and when the first reference value (Do+Op−Dx) is input into the target TFT PT. Accordingly, the first reference value (Do+Op−Dx) of the target TFT Pt corresponding to the sensed value Vs may be obtained through the lookup table 112A having the inverse gamma characteristic of the target TFT Pt. Then the second offset compensation value Dx may be obtained by subtracting the first reference value (Do+Op−Dx) from the sensing data (Do+Op).

Figure 14:
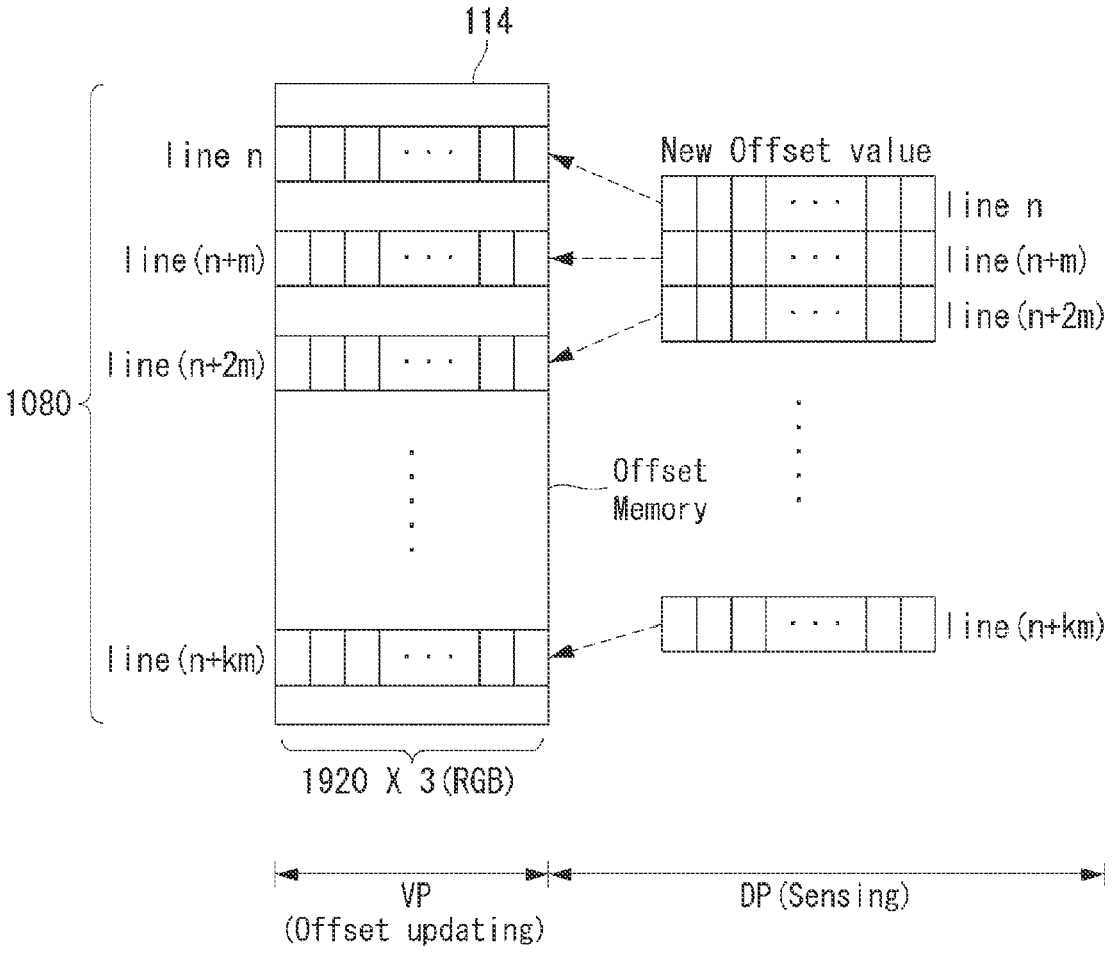
FIG. 14 is a schematic diagram showing an example in which a plurality of horizontal display lines are sensed within one frame and offset compensation values are updated.

FIG. 14 is a schematic diagram showing an example in which a plurality of horizontal display lines are sensed within one frame and offset compensation values are updated.

In the FIG. 14 example, a plurality of horizontal display lines each including a plurality of pixels are provided on the display panel. One horizontal display line may be sensed every frame. The horizontal display lines may be sequentially sensed downward from the top of the screen in the display data writing order, or randomly sensed regardless of the display data writing order. Embodiments are not limited to these schemes. According to this sensing method, when a number of frames equal to the number of horizontal display lines are accumulated, the offset compensation values for all the pixels on the display panel may be updated. For example, if the number of horizontal display lines is 1080 and the frame rate is 60 Hz, it takes about eighteen (18) seconds to update the offset compensation values for all pixels. This updating period may be appropriate, given the speed of changes in a normal TFT over time.

In addition, the number of horizontal display lines to be sensed and updated every frame may be increased in order to shorten the sensing period (updating period). In one example, k horizontal display lines ("k" being a positive integer less than the number of horizontal display lines) may be sensed every frame. Again, the order in which the horizontal display lines are sensed may be sequentially sensed downward from the top of the screen in the display data writing order or randomly sensed regardless of the display data writing order. Embodiments are not limited to these schemes. As an example, FIG. 14 illustrates that (k+1) horizontal display lines selected at intervals of m horizontal display lines may be sequentially or randomly sensed within the display period DP of each frame. Then the offset compensation values for the (k+1) horizontal display lines may be updated within the vertical blank period VP of each frame.

Figure 15:
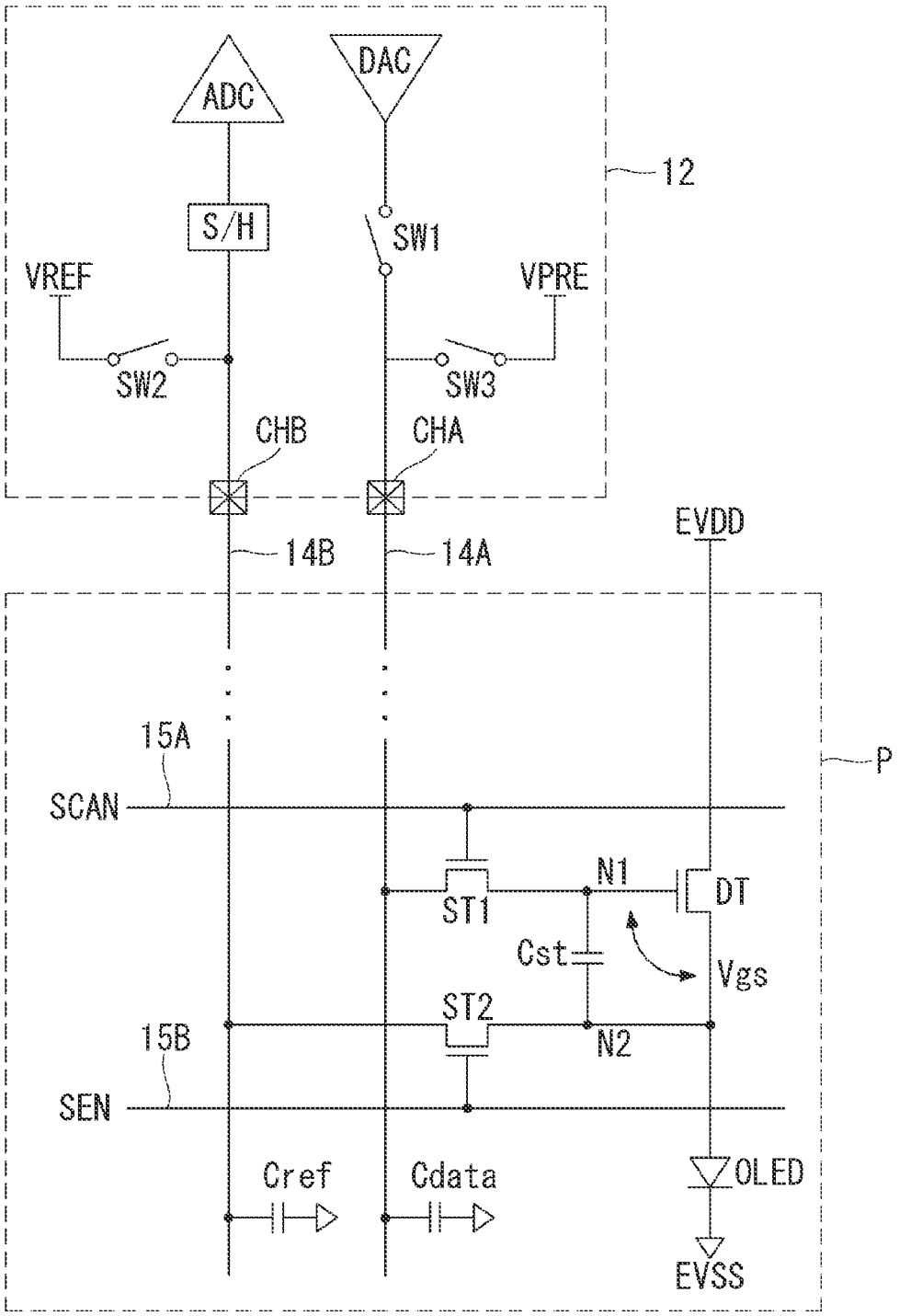
FIG. 15 is a circuit diagram showing a pixel configuration and a data driving circuit configuration for sensing pixel current.
Figure 16:
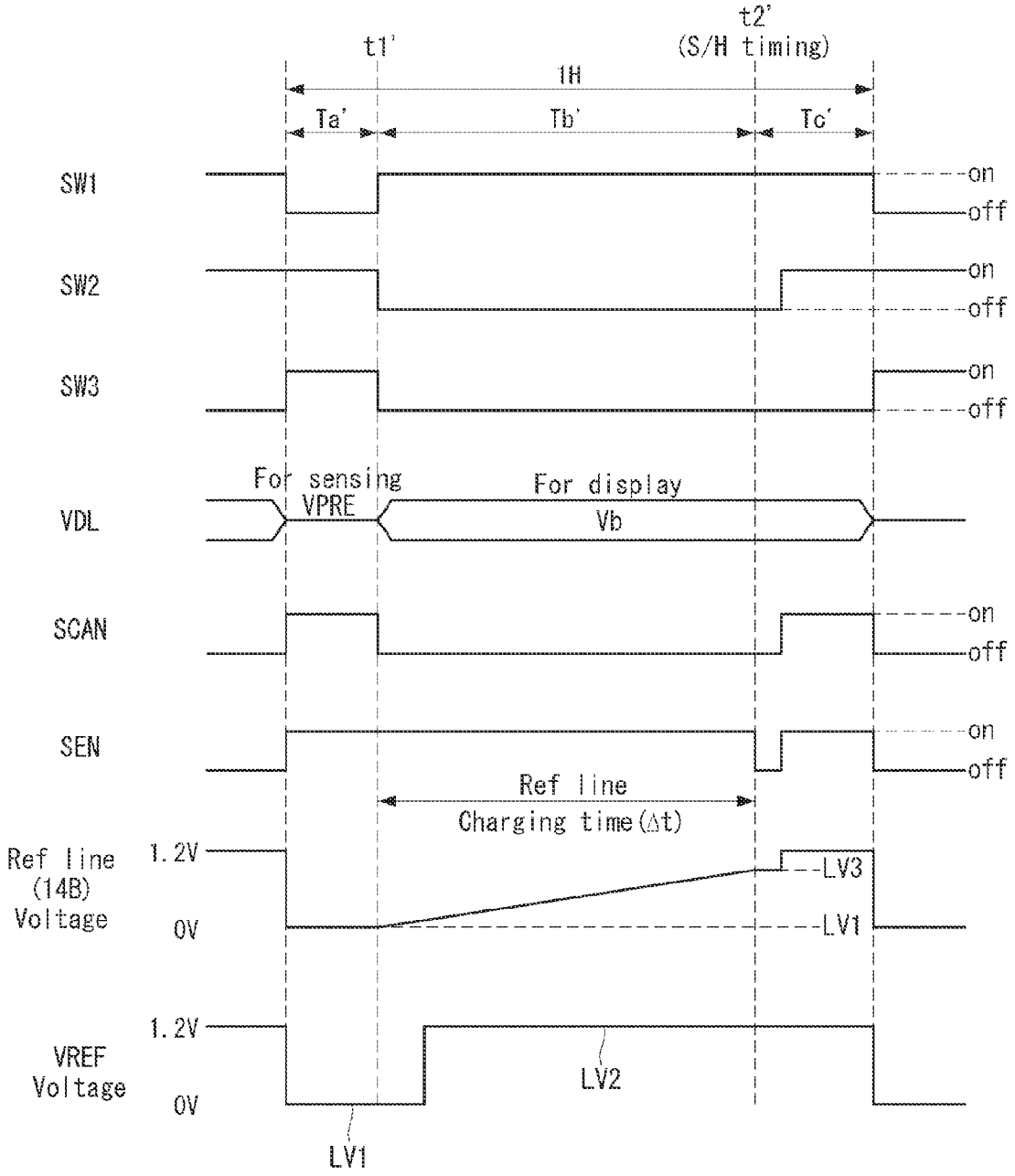
FIG. 16 is a timing diagram showing a driving timing for explaining the operation of FIG. 15.

FIG. 15 is a circuit diagram showing a pixel configuration and a data driving circuit configuration for sensing pixel current according to an embodiment. FIG. 16 is a timing diagram showing a driving timing for explaining the operation of FIG. 15. The explanation of the sensing operation of FIGS. 15 and 16 is substantially identical to the explanation given with reference to FIGS. 8 and 9.

The examples of FIGS. 8 and 9 have explained the use of DAC output as analog sensing data Va. In general, the DAC output range of the data driving circuit 12 may be predetermined. If the DAC has low driving capability, the data line 14A with large parasitic capacitance may not be charged to a desired voltage level within a relatively short time (Ta of FIG. 9), and this may cause problems with sensing.

To overcome this, as shown in the examples of FIGS. 15 and 16, embodiments may use a fixed voltage VPRE generated by a power source as analog sensing data by connecting the power source to the first output channel CHA of the data driving circuit 12 and supplying the fixed voltage VPRE to the data line 14A. To this end, as shown in the FIG. 15 example, the data driving circuit 12 may further include a third switch SW3, in addition to the components SW1 and SW2 explained in FIG. 8. The third switch SW3 may switch the flow of current between the power supply and the first output channel CHA. As shown in the FIG. 16 example, the third switch SW3 may be turned on only in the first period Ta' for writing sensing data VREF.

Using the fixed voltage VPRE as sensing data may quickly charge the data line 14A, and may allow sufficient time to charge the reference line 14B, thus offering advantages in increasing sensing accuracy. That is, as shown in FIG. 16, the first period Ta' may be shortened in comparison with the first period Ta of FIG. 8, and the second period Tb' may be lengthened in comparison with the second period Tb of FIG. 8.

Figure 17:
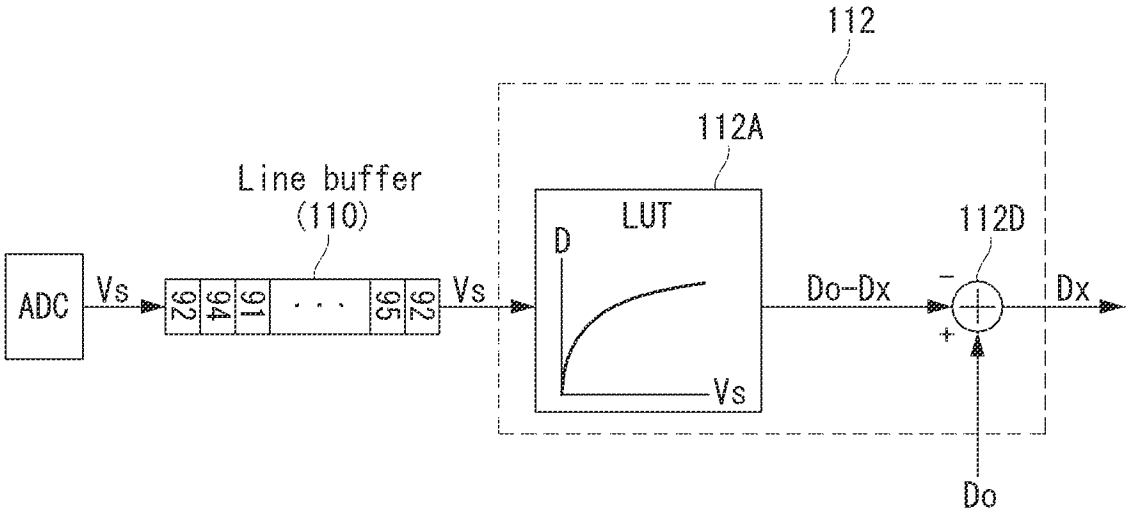
FIG. 17 is a schematic diagram showing a detailed configuration of the offset calculator applied in FIGS. 15 and 16.
Figure 18:
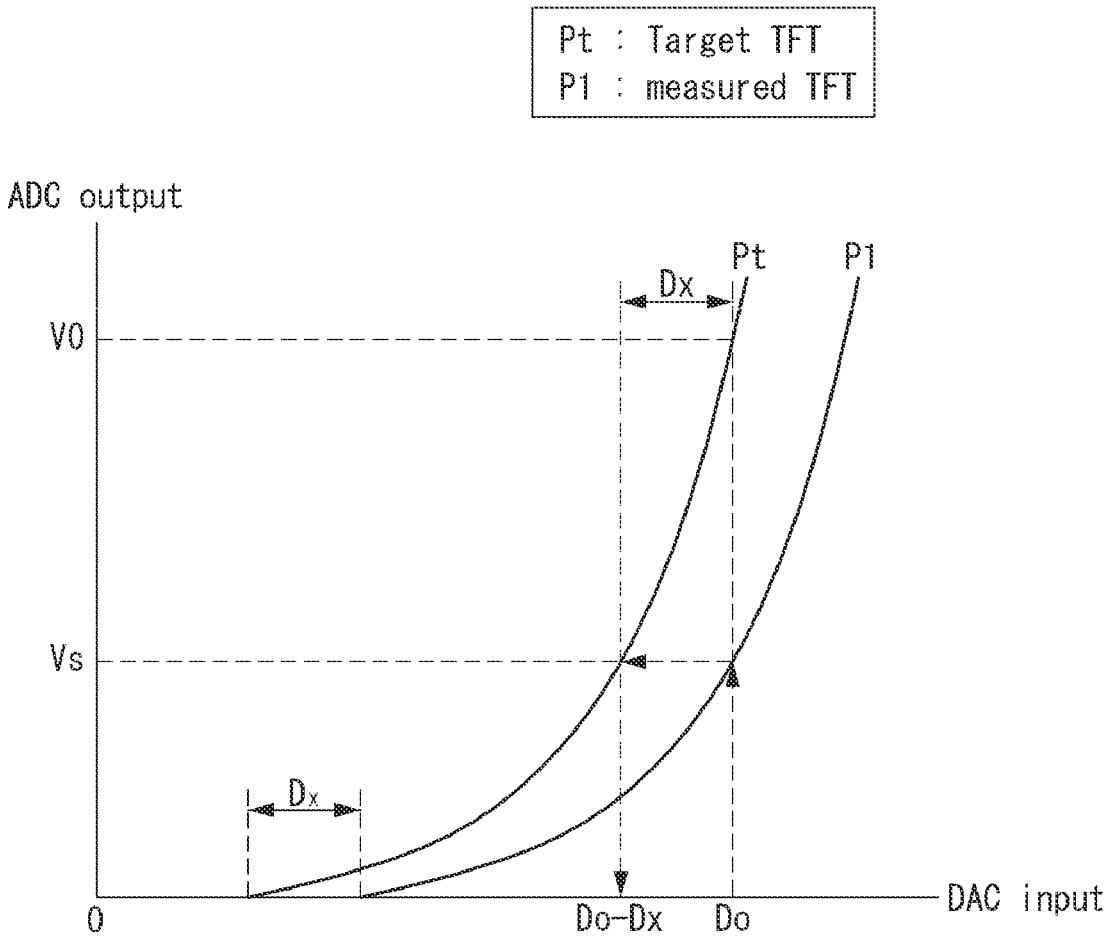
FIG. 18 is a graph for explaining a calculation principle associated with FIG. 17.

FIG. 17 is a schematic diagram showing a detailed configuration of the offset calculator applied in FIGS. 15 and 16. FIG. 18 is a graph for explaining a calculation principle associated with FIG. 17.

The sensing data Do of FIGS. 15 and 16 may be written as a fixed value VPRE to measured pixels regardless of the offset compensation value. When all the measured pixels P on the same horizontal display line are sensed, the ADC may sequentially convert the values sensed for the measured pixels P into digital values, and then may supply them to the line buffer 110.

Then, the offset calculator 112 may receive the sensed values Vs from the line buffer 110, and may calculate a second offset compensation value Dx for compensating for offset changes made to the measured pixels P during one sensing period based on the sensed values Vs. To this end, as shown in FIG. 17, the offset calculator 112 may include a lookup table 112A and an adder 112D.

The lookup table 112A may output a second reference value (Do-Dx) by using a sensed value Vs as a read address. The second reference value (Do-Dx) may be preset for a target TFT Pt that may have no offset change during one sensing period, which may change with the sensed value along the Pt curve of FIG. 18. The P1 curve of the FIG. 18 example shows the characteristics of a measured TFT P1 included in a measured pixel P. The characteristics of the driving TFT P1 included in each measured pixel P are based on the premise that the driving TFT P1 has the same characteristic-curve slope as the target TFT Pt.

The adder 112D may output a second offset compensation value Dx (for compensating for offset changes made to the measured TFT P1 with respect to the target TFT Pt) by subtracting the sensing data Do from second reference value Do-Dx corresponding to the same sensed value Vs. The ADC output, which is the sensed value Vs corresponding to the pixel current, may be the same both when the sensing data Do is input into the measured TFT P1 and when the first reference value Do-Dx is input into the target TFT PT. Accordingly, the first reference value Do-Dx of the target TFT Pt corresponding to the sensed value Vs may be obtained through the lookup table 112A having the inverse gamma characteristic of the target TFT Pt. Then, the second offset compensation value Dx may be obtained by subtracting the first reference value Do-Dx from the sensing data Do.

Figure 19:
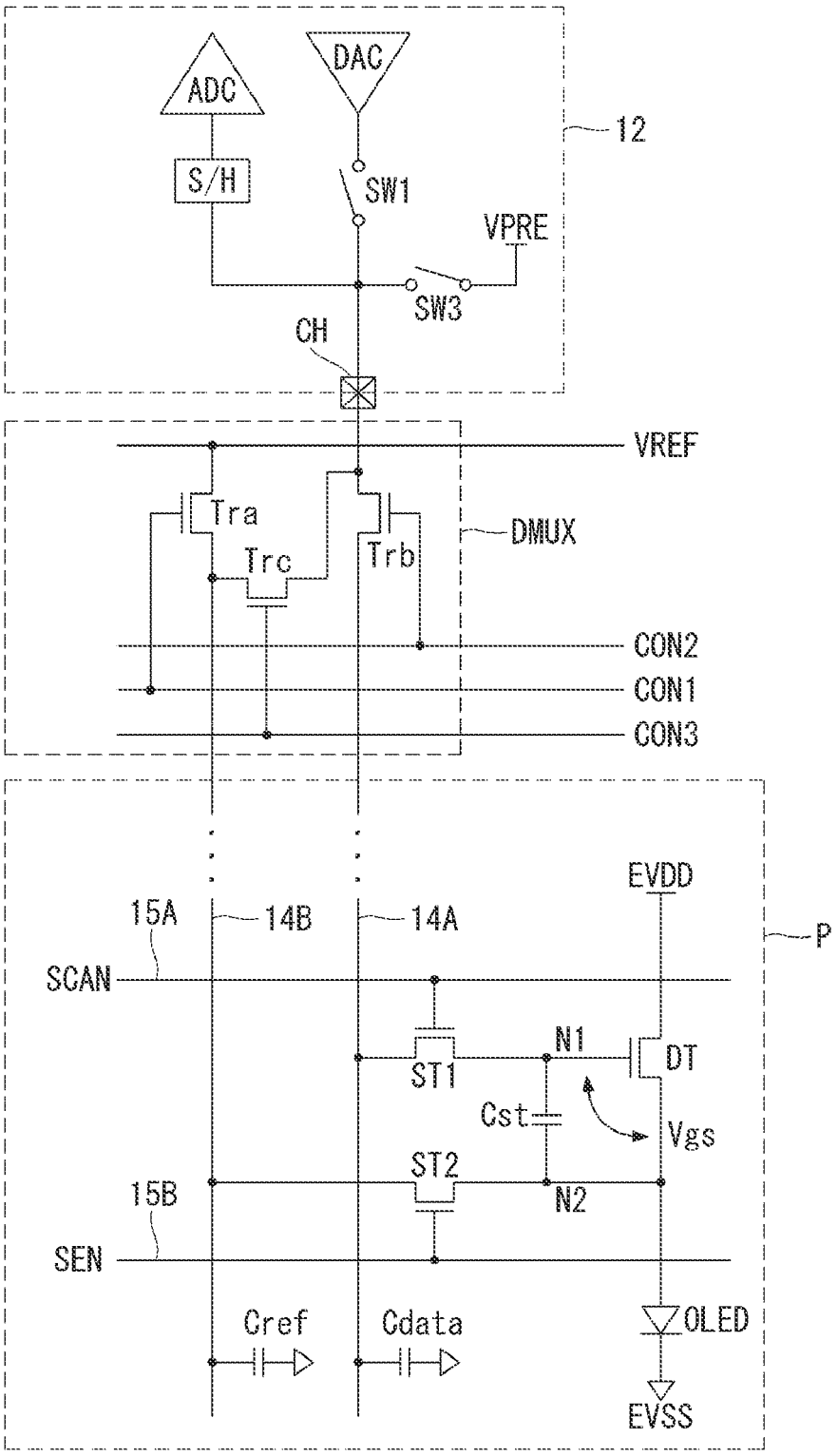
FIG. 19 is a circuit diagram showing a pixel configuration and a data driving circuit configuration for sensing pixel current according to an embodiment.
Figure 20:
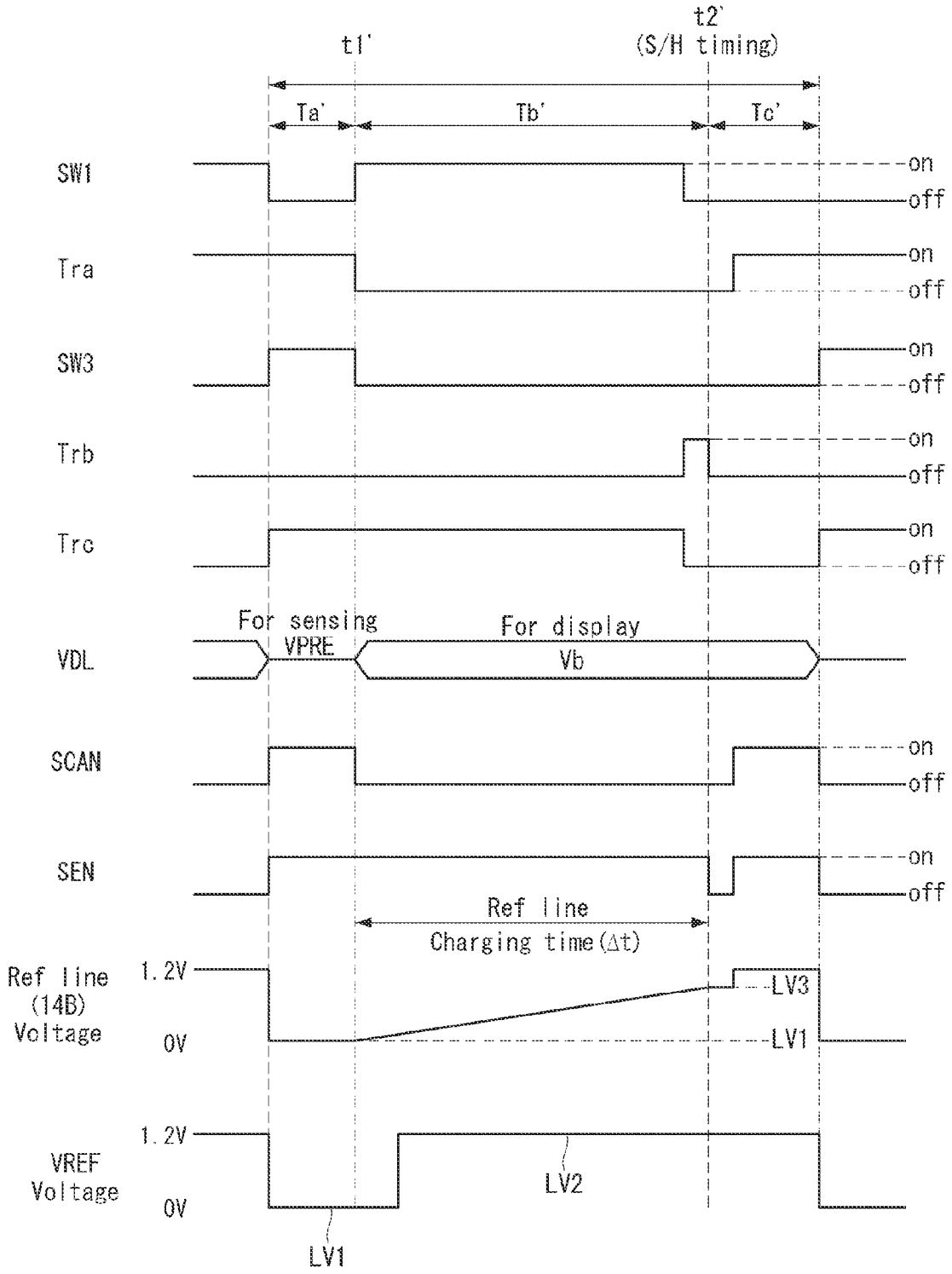
FIG. 20 is a timing diagram showing a driving timing for explaining the operation of FIG. 19.

FIG. 19 is a circuit diagram showing a pixel configuration and a data driving circuit configuration for sensing pixel current according to an embodiment. FIG. 20 is a timing diagram showing a driving timing for explaining the operation of FIG. 19. The explanation of the sensing operation of FIGS. 19 and 20 is substantially identical to the explanation given with reference to FIGS. 8 and 9.

With reference to FIG. 19, a demux circuit DMUX may be further provided between the pixel P and the data driving circuit 12. The demux circuit DMUX may reduce the number of output channels of the data driving circuit 12 by connecting the data line 14A and the reference line 14B commonly to one output channel of the data driving circuit 12.

With reference to the examples of FIGS. 19 and 20, the demux circuit DMUX may include first to third demux switches Tra, Trb, Trc. The first demux switch Tra may be connected between the reference voltage source VREF and the reference line 14B, and may be switched on in response to a first demux control signal CON1. The first demux switch Tra may be turned on in the first and third periods Ta' and Tc' to apply the first reference voltage LV1 to the reference line 14B during the first period Ta', and to apply the second reference voltage LV2, different from the first reference voltage LV1, to the reference line 14B.

The second demux switch Trb may be connected between one output channel CH of the data driving circuit 12 and the data line 14A, and may be switched on in response to a second demux control signal CON2. The second demux switch Trb may be turned on in part of the second period Tb', which may optionally be carried over from being turned on in the first period Ta', to connect the data line 14A to the output channel CH of the data driving circuit 12. Alternatively, the second demux switch Trb may be turned off during the first period Ta' and may be turned on later during part of the second period Tb'.

The third demux switch Trc may be connected between the output channel CH of the data driving circuit 12 and the reference line 14B, and may be switched in response to a third demux control signal CON3. The third demux switch Trc may be turned on in the remaining part of the second period Tb' to connect the reference line 14B to the output channel CH of the data driving circuit 12 until the second demux switch Trb is turned on. The third demux switch Trc may also be turned on in the first period Ta', depending on when during the second period Tb' the second demux switch Trb is turned on.

Figure 21:
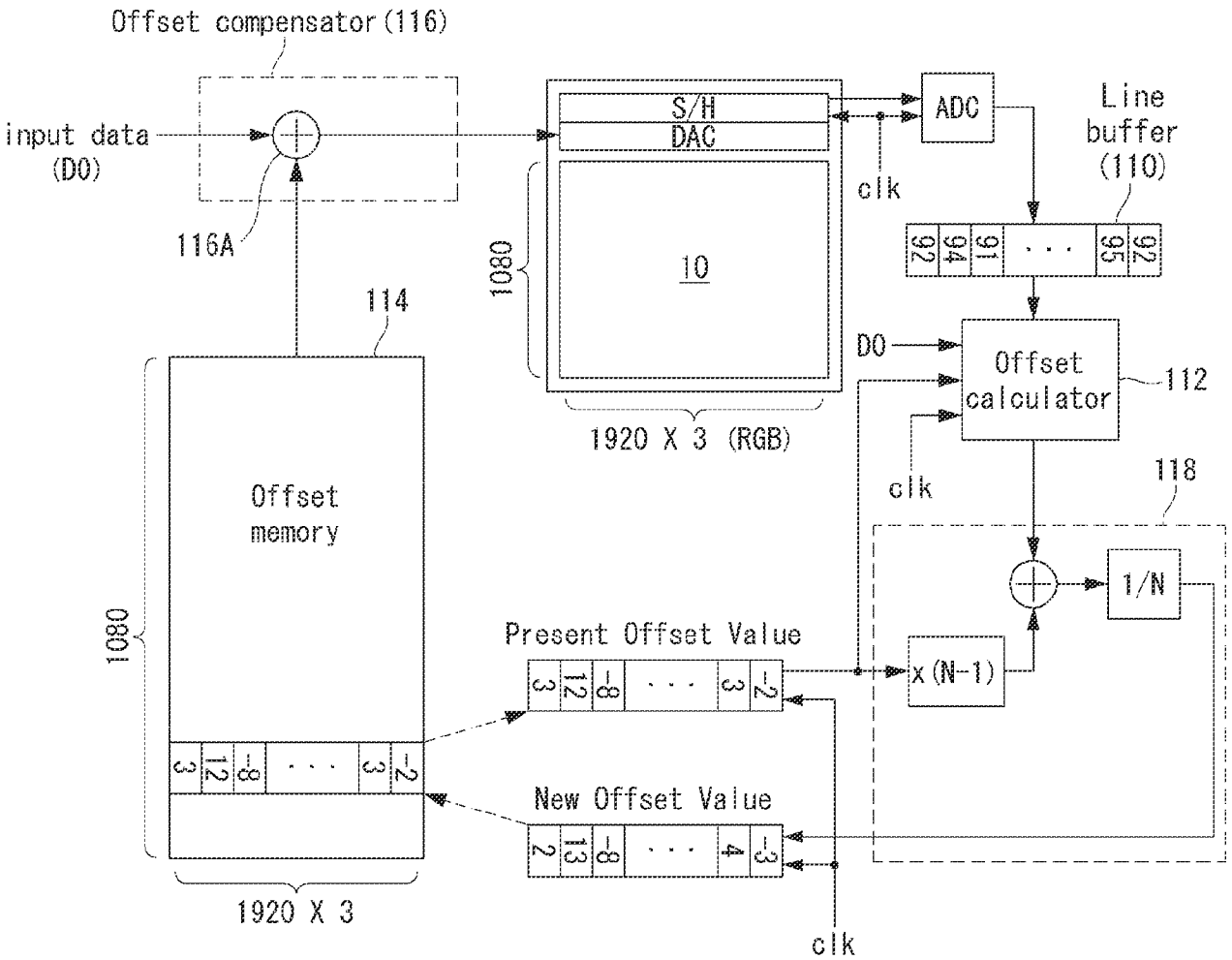
FIGS. 21 and 22 are schematic diagrams showing a configuration for explaining in detail the derivation and update of an offset compensation value according to an embodiment.
Figure 22:
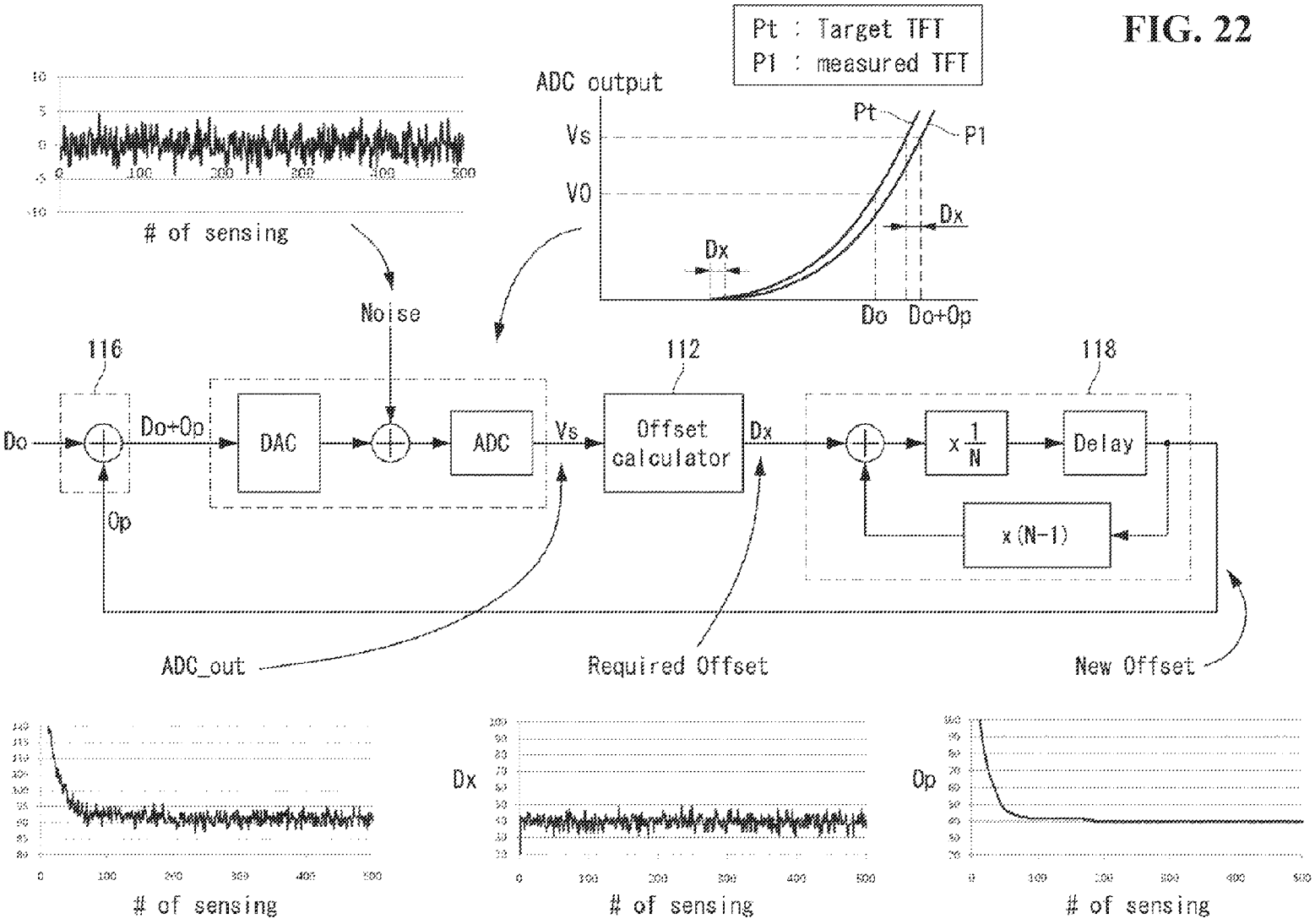

FIGS. 21 and 22 are schematic diagrams showing a configuration for explaining in detail the derivation and update of an offset compensation value according to an embodiment.

With reference to the examples of FIGS. 21 and 22, the timing controller 11 may further include a noise canceller 118, as well as the line buffer 110, the offset calculator 112, the offset memory 114, and the offset compensator 116, in order to derive and update an offset compensation value. The line buffer 110, the offset calculator 112, the offset memory 114, and the offset compensator 116 are substantially identical to those explained in FIG. 7 and a detailed description thereof is not repeated.

An offset compensation value output from the offset compensator 112 may include an undesired noise. The offset compensation value does not change rapidly because offset changes are made over time. Accordingly, high-frequency noise components may be eliminated by averaging multiple offset compensation values obtained by repeated sensing operations. However, a large-capacity frame memory is typically used for this averaging operation, aside from the offset memory 114.

For this reason, embodiments may further include a noise canceller 118 for cancelling noise effects, without addition of a frame memory. The noise canceller 118 may cancel noise components included in the second offset compensation value Dx by adding the second offset compensation value Dx input from the offset calculator 112 to the resultant value obtained by multiplying a first offset compensation value "x" stored in the offset memory 114 in the previous sensing period by (N−1) ("N" being a real number equal to or greater than 2) and dividing the resultant value by N.

Figure 23:
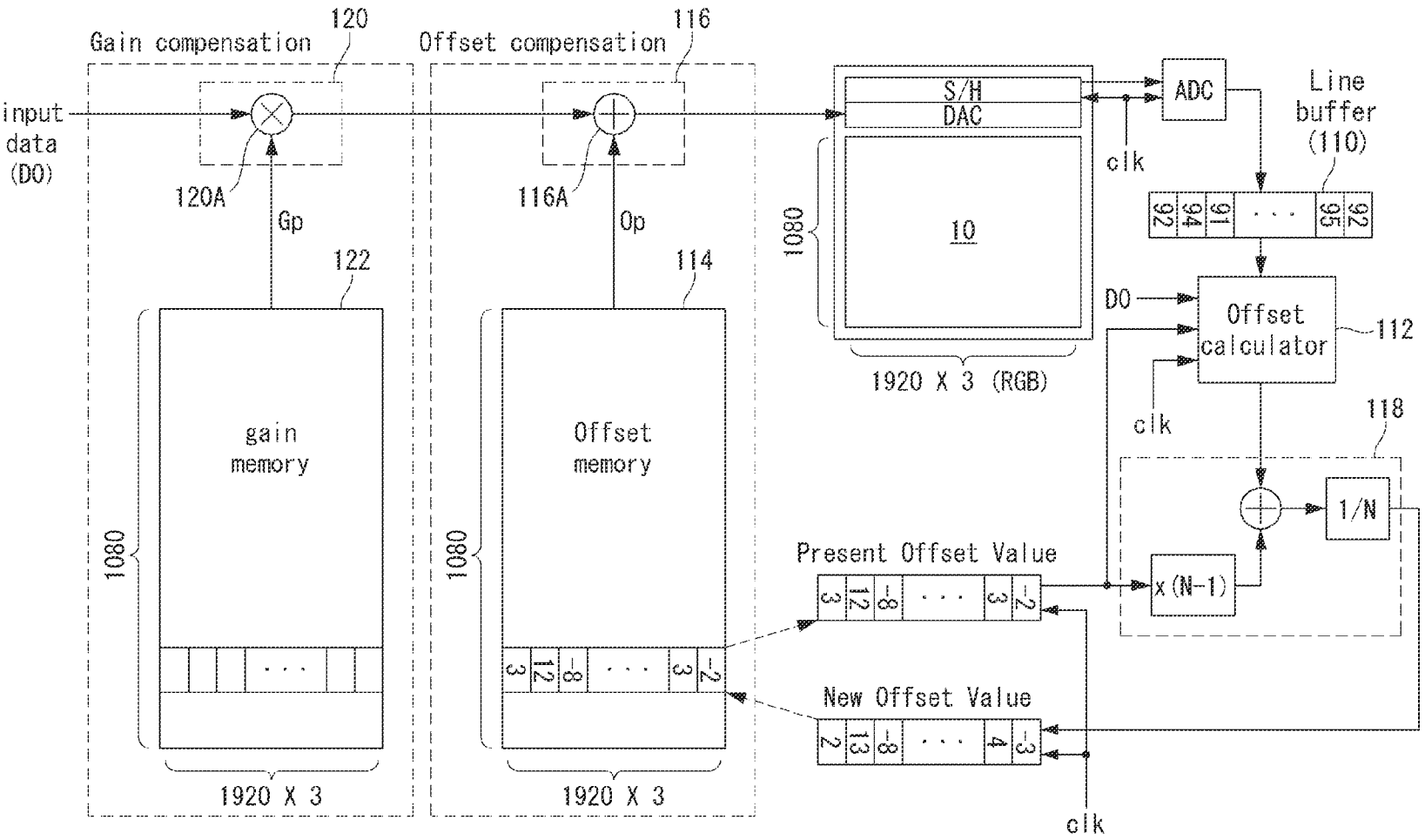
FIG. 23 is a schematic diagram showing a configuration for explaining in detail the derivation and update of an offset compensation value according to an embodiment.
Figure 24:
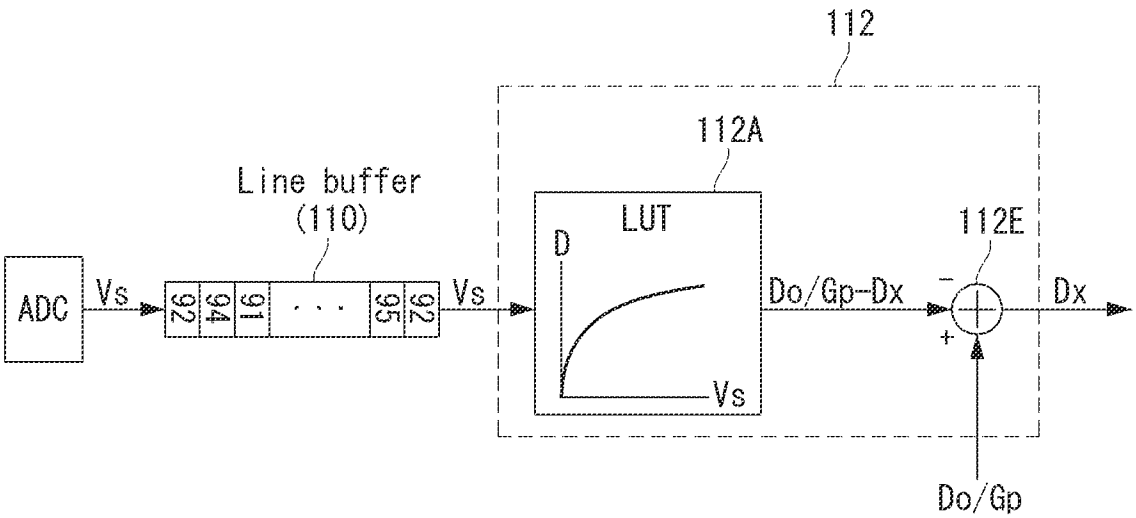
FIG. 24 is a schematic diagram showing one detailed configuration of the offset calculator of FIG. 23.

FIG. 23 is a schematic diagram showing a configuration for explaining in detail the derivation and update of an offset compensation value according to an embodiment. FIG. 24 is a schematic diagram showing one detailed configuration of the offset calculator of FIG. 23.

In the foregoing description, it is presumed that the mobility of the driving TFT does not change over time and therefore there are no differences in mobility between the pixels. However, it may be preferable that a gain memory 122 storing gain compensation values and a gain compensator 120 are further provided as shown in FIG. 23 to perform mobility pre-compensation before performing offset compensation on the sensing data Do in case the mobility of the driving TFT changes over time.

In an example in which mobility pre-compensation is applied to the embodiment (e.g., FIGS. 10-12) using the DAC output as analog sensing data, the sensing data Do is multiplied Gp times by a multiplier 120A and then input into the DAC. Thus, pixel current sensing may be performed after compensating for any differences in mobility. Accordingly, the offset calculator 112 may perform a calculation in the same way as previously described.

On the other hand, in an example in which mobility pre-compensation is applied to the embodiment (e.g., FIGS. 15-19) using a fixed voltage VPRE as analog sensing data, differences in mobility are not applicable to the sensing data Do. Thus, when performing an offset calculation, the offset calculator 112 may use (1/Gp) of the sensing data (Do/Gp), obtained by using a pixel gain compensation value Gp as shown in FIG. 24.

As described above, embodiments may compensate for luminance variations caused by changes in a driving element over time by writing sensing data to a pixel on a horizontal display line through a data line, sensing the pixel current of the pixel through a reference line, and then writing display data compensated by a first offset compensation value to the pixel, within one horizontal display period allocated to each horizontal display line of the display panel to write image display data. According to embodiments, the bezel area may be reduced as there is no need to install separate gate drivers for sensing and display purposes, and the problem of display image distortion caused by sensing data may be prevented because a sensing operation is performed within one horizontal display period before writing of display data. The light-emitting element may be an OLED. The driving element may be a driving TFT.

It will be apparent to those skilled in the art that various modifications and variations can be made in the present invention without departing from the spirit or scope of the invention. Thus, it is intended that embodiments of the present invention cover the modifications and variations of this invention provided they come within the scope of the appended claims and their equivalents.

What is claimed is:

1. An organic light emitting display, comprising:

a display panel comprising a plurality of pixels, each pixel comprising:

a light emitting element; and a driving element configured to drive the light emitting element;

a data driving circuit configured to, within one horizontal display period allocated to each horizontal display line of the display panel to write image display data:

write sensing data to a pixel on a horizontal display line through a data line;

sense a pixel current value of the pixel through a reference line; and then write display data compensated by a first offset compensation value to the pixel;

an offset calculator configured to calculate a second offset compensation value for compensating changes in the driving element over time based on the sensed value of the pixel current; and an offset memory configured to update the first offset compensation value, that is pre-stored in the memory, with the second offset compensation value within a vertical blank period when display data writing is stopped, wherein the pixel further comprises:

a first switching TFT configured to connect between the data line and a gate node of the driving element in response to a scan control signal supplied from a gate driving circuit, and a second switching TFT configured to connect between the reference line and a source node of the driving element in response to a sensing control signal supplied from the gate driving circuit, wherein the one horizontal display period comprises:

a first period for writing the sensing data, a second period for sensing the a voltage stored in the reference line in response to the pixel current, and a third period for writing the display data, wherein the sensing control signal is generated in the form of two pulses within the one horizontal display period in such a manner that the sensing control signal is:

maintained at the on level in the first and second periods; and then inverted from the off level to the on level within the third period, wherein the data line and the reference line are connected to one output channel of the data driving circuit through a demux circuit, and wherein the demux circuit comprises:

a first demux switch configured to be turned on in the first and third periods to:

apply a first reference voltage to the reference line during the first period; and apply a second reference voltage, different from the first reference voltage, to the reference line, a second demux switch configured to be turned during part of the second period to connect the data line to the output channel of the data driving circuit, and a third demux switch configured to be turned on in a remaining part of the second period, in which the second demux switch is turned off, to connect the reference line to the output channel of the data driving circuit.

2. The organic light emitting display of claim 1, further comprising:

an offset compensator configured to:

respectively apply the first offset compensation value to input display data and input sensing data; and then supply the display data and the sensing data to the data driving circuit;

wherein the sensing data, to which the first offset compensation value has been applied, is written to the pixel.

3. The organic light emitting display of claim 2, wherein the offset calculator comprises:

a lookup table configured to output a first reference value according to the sensed value; and an adder configured to output the second offset compensation value by performing an operation on the sensing data, to which the first offset compensation value has been applied, and the first reference value.

4. The organic light emitting display of claim 1, wherein the sensing data is written as a fixed value to the pixel regardless of the first offset compensation value.

5. The organic light emitting display of claim 4, wherein the offset calculator comprises:

a lookup table configured to output a second reference value according to the sensed value; and an adder configured to output the second offset compensation value by performing an operation on the sensing data, which is the fixed value, and the second reference value.

6. The organic light emitting display of claim 1, further comprising a noise canceller configured to cancel noise components included in the second offset compensation value by adding the second offset compensation value input from the offset calculator to the resultant value obtained by multiplying the first offset compensation value by (N−1) and dividing the resultant value by N, N being a real number equal to or greater than 2.

7. The organic light emitting display of claim 1, wherein:

the pixel further comprises a storage capacitor connected between the gate node and source node of the driving element;

the scan control signal is generated in a form of two pulses within the one horizontal display period such that the scan control signal is:

maintained at an on level in the first period;

maintained at an off level in the second period; and then inverted from the off level to the on level within the third period.

8. The organic light emitting display of claim 7, wherein the data driving circuit is further configured to:

apply a first reference voltage to the reference line during the first period; and apply a second reference voltage, different from the first reference voltage, to the reference line.

9. The organic light emitting display of claim 1, further comprising:

a plurality of horizontal display lines on the display panel, each of the plurality of horizontal display lines comprising a plurality of pixels, wherein k horizontal display lines are sensed every frame, k being a positive integer less than a total number of horizontal display lines, and wherein an order in which the horizontal display lines are sensed is sequentially sensed downward from a top of a screen in a display data writing order or is randomly sensed regardless of the display data writing order.

10. A method of manufacturing an organic light emitting display, the method comprising:

providing a display panel comprising a plurality of pixels, each pixel comprising:

a light emitting element; and a driving element configured to drive the light emitting element;

providing a data driving circuit configured to, within one horizontal display period allocated to each horizontal display line of the display panel to write image display data:

write sensing data to a pixel on a horizontal display line through a data line;

sense a pixel current value of the pixel through a reference line; and then write display data compensated by a first offset compensation value to the pixel;

providing an offset calculator configured to calculate a second offset compensation value for compensating changes in the driving element over time based on a sensed value of the pixel current; and providing an offset memory configured to update the first offset compensation value, that is pre-stored in the memory, with the second offset compensation value within a vertical blank period when display data writing is stopped, wherein the providing the pixel further comprises:

providing a first switching TFT configured to connect between the data line and a gate node of the driving element in response to a scan control signal supplied from a gate driving circuit, and providing a second switching TFT configured to connect between the reference line and a source node of the driving element in response to a sensing control signal supplied from the gate driving circuit, wherein the one horizontal display period comprises:

a first period for writing the sensing data, a second period for sensing the a voltage stored in the reference line in response to the pixel current, and a third period for writing the display data, wherein the sensing control signal is generated in the form of two pulses within the one horizontal display period in such a manner that the sensing control signal is:

maintained at the on level in the first and second periods; and then inverted from the off level to the on level within the third period, wherein the data line and the reference line are connected to one output channel of the data driving circuit through a demux circuit, and wherein the providing the demux circuit comprises:

providing a first demux switch configured to be turned on in the first and third periods to:

apply a first reference voltage to the reference line during the first period; and apply a second reference voltage, different from the first reference voltage, to the reference line, providing a second demux switch configured to be turned during part of the second period to connect the data line to the output channel of the data driving circuit, and providing a third demux switch configured to be turned on in a remaining part of the second period, in which the second demux switch is turned off, to connect the reference line to the output channel of the data driving circuit.

11. The method of claim 10, further comprising:

providing an offset compensator configured to:

respectively apply the first offset compensation value to input display data and input sensing data; and then supply the display data and the sensing data to the data driving circuit;

wherein the sensing data, to which the first offset compensation value has been applied, is written to the pixel.

12. The method of claim 11, wherein the providing the offset calculator comprises:

providing a lookup table configured to output a first reference value according to the sensed value; and providing an adder configured to output the second offset compensation value by performing an operation on the sensing data, to which the first offset compensation value has been applied, and the first reference value.

13. The method of claim 10, wherein the sensing data is written as a fixed value to the pixel regardless of the first offset compensation value.

14. The method of claim 13, wherein the providing the offset calculator comprises:

providing a lookup table configured to output a second reference value according to the sensed value; and an adder configured to output the second offset compensation value by performing an operation on the sensing data, which is the fixed value, and the second reference value.

15. The method of claim 10, further comprising providing a noise canceller configured to cancel noise components included in the second offset compensation value by adding the second offset compensation value input from the offset calculator to the resultant value obtained by multiplying the first offset compensation value by (N−1) and dividing the resultant value by N, N being a real number equal to or greater than 2.

16. The method of claim 10, wherein:

the providing the pixel further comprises providing a storage capacitor connected between the gate node and source node of the driving element;

the scan control signal is generated in a form of two pulses within the one horizontal display period such that the scan control signal is:

maintained at an on level in the first period;

maintained at an off level in the second period; and then inverted from the off level to the on level within the third period.

17. The method of claim 16, wherein the data driving circuit:

applies a first reference voltage to the reference line during the first period; and applies a second reference voltage, different from the first reference voltage, to the reference line.

18. The method of claim 10, further comprising:

providing a plurality of horizontal display lines on the display panel, each of the plurality of horizontal display lines comprising a plurality of pixels, wherein k horizontal display lines are sensed every frame, k being a positive integer less than a total number of horizontal display lines, and wherein an order in which the horizontal display lines are sensed is sequentially sensed downward from a top of a screen in a display data writing order or randomly sensed regardless of the display data writing order.

* * * * *